US005445926A

United States Patent [19]

Hasebe

[11] Patent Number: 5,445,926

[45] **Date of Patent: * Aug. 29, 1995**

[54] METHOD OF FORMING SILVER HALIDE COLOR PHOTOGRAPHIC IMAGES

[75] Inventor: Kazunori Hasebe, Kanagawa, Japan

[73] Assignee: Fuji Photo Film Co., Ltd., Kanagawa, Japan

[ * ] Notice: The portion of the term of this patent subsequent to Feb. 22, 2011 has been disclaimed.

[21] Appl. No.: 965,028

[22] Filed: Oct. 23, 1992

[30] Foreign Application Priority Data

Oct. 23, 1991 [JP] Japan ..... 3-302662

[51] Int. Cl.[6] ..... G03C 1/34; G03C 1/815; G03C 5/31; G03C 7/32

[52] U.S. Cl. ..... 430/399; 430/512; 430/551; 430/362; 430/558; 430/386; 430/387

[58] Field of Search ..... 430/399, 512, 551, 362, 430/558, 386, 387

[56] References Cited

U.S. PATENT DOCUMENTS

| | | | |
|---|---|---|---|
| 4,456,681 | 6/1984 | Kadowaki et al. | 430/512 |
| 4,540,654 | 9/1985 | Sato et al. | 430/381 |
| 4,931,382 | 6/1990 | Morigaki et al. | 430/512 |
| 4,945,031 | 7/1990 | Sakai et al. | 430/551 |
| 5,288,599 | 2/1994 | Takahashi et al. | 430/551 |

FOREIGN PATENT DOCUMENTS

| | | |
|---|---|---|
| 0297836 | 1/1989 | European Pat. Off. . |
| 0384487 | 8/1990 | European Pat. Off. . |
| 0425258 | 5/1991 | European Pat. Off. . |
| 0459334 | 12/1991 | European Pat. Off. . |

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

Disclosed is a method for processing color photographic materials having a layer structure in which a cyan color-forming layer is disposed on the upper side of a pyrazoloazole type magenta coupler-containing magenta color-forming layer. A layer which does not contain any hydroquinones but contains a ultraviolet absorbent is provided above the cyan coupler-containing silver halide emulsion layer having a high chloride content, while below the cyan coupler-containing emulsion layer is provided another layer containing hydroquinones but not containing any ultraviolet absorbent. These materials are processed rapidly with a color developer under a reduced replenishment condition, wherein the amount of a color developer replenished is controlled to below 120 ml/m$^2$, to provide color images fast to light and free from bluish unevenness in the edge part thereof.

38 Claims, No Drawings

METHOD OF FORMING SILVER HALIDE COLOR PHOTOGRAPHIC IMAGES

FIELD OF THE INVENTION

The present invention relates to a method of forming silver halide color photographic images and, more particularly to a method of forming color photographic images, which has an aptitude for rapid processing, ensures an excellent keeping quality in the photographic images after photographic processing, and can prevent changes in photographic characteristics, to produce consistently color photographs of good quality even when the silver halide color photographic materials are continuously processed with a color developer under a reduced replenishment condition.

BACKGROUND OF THE INVENTION

As color photographs have become more popular in recent years, the need for reduction in development time and prevention of environmental pollution has become stronger and stronger.

New systems answering this need for rapid processing, in which a photographic material comprising silver halide emulsions with a high chloride content and a developing solution free from sulfites and benzyl alcohol (which are contained in color developing solution for general color paper use), are used in combination, are disclosed, e.g., in WO 87/04534 and JP-A-64-26837 (the term "JP-A" as used herein means an "unexamined published Japanese patent application"). Manufactured goods utilizing those systems are slowly entering in the market.

As for the requirement for reduction in environmental pollution, the use of a developing solution free from benzyl alcohol has already furnished a solution to such pollution problems. Moreover, it has been desired to decrease the amount of replenisher used during continuous color development from the standpoint of decreasing the quantity of wastes discharged during the development step or even doing away with the wastes themselves. Methods to be adopted therefor are disclosed, e.g., in JP-A-61-70552, JP-A-63-106655, JP-A-01-302351 and JP-A-01-302352.

However, when reduction in replenishment was carried out in the development of color prints according to such methods, bluish uneven finish is sometimes observed in the edge part of images which should have developed primarily a black to gray color.

SUMMARY OF THE INVENTION

Therefore, an object of the present invention is to combine an aptitude for a low-replenished developing solution with an excellent aptitude for rapid processing which a silver halide photographic material having a high chloride content possesses. More specifically, it is to provide a method of producing color photographic images in the form of color prints which solves the problem of rapid processing with a developing solution at a reduced replenishment rate and prevents uneven color formation in the edge part of color print images.

It has now been found that the above-described object can be attained with:

[1] a method of producing silver halide color photographic images comprising the step of color developing a silver halide color photographic material which comprises on a reflecting support and provided thereon three light sensitive silver halide emulsion layers each having a light sensitivity to a different wavelength region, including a light sensitive silver halide emulsion layer containing a yellow dye forming coupler, a light sensitive silver halide layer containing a magenta dye forming coupler, and a light sensitive layer containing a-cyan dye forming coupler, wherein said photographic material containing at least one magenta coupler represented by the following general formula (M) in the magenta coupler-containing silver halide emulsion layer and having the cyan coupler-containing silver halide emulsion layer situated in a position more distant from the support than the magenta coupler-containing silver halide emulsion layer, and wherein (a) a hydrophilic light-insensitive layer containing a compound represented by the following general formula (I) in the substantial absence of any ultraviolet absorbent is provided at a position on the support side of the cyan coupler-containing silver halide emulsion layer, (b) a hydrophilic light-insensitive layer containing an ultraviolet absorbent in the substantial absence of any compound represented by the following general formula (I) is provided above the cyan coupler-containing silver halide emulsion layer, and (c) silver halide grains contained in every emulsion layer have an average silver chloride content of at least 90 mol %; and wherein said color development is performed continuously with a color developing solution at a replenishment rate of at most 120 ml of a replenisher per $m^2$ of silver halide color photographic material processed thereby,

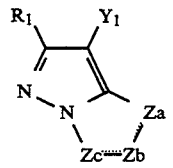

(M)

(wherein $R_1$ represents a hydrogen atom or a substituent group; Y1 represents a hydrogen atom or a splitting off group; Za, Zb and Zc each represent an unsubstituted or substituted methine group, —N— or —NH—; either the Za—Zb bond or the Zb—Zc bond is a double bond, and the other is a single bond; when the Za—Zb bond is a carbon-carbon double bond, it may constitute part of an aromatic ring; and which may form a dimer or higher polymer via $R_1$, $Y_1$ or a substituted methine when Za, Zb or Zc represents the substituted methine group),

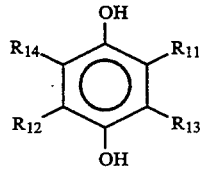

(I)

(wherein $R_{11}$ represents a hydrogen atom or a substituent group; $R_{12}$ may be the same as $R_{11}$ or different therefrom, and represents a hydrogen atom or a substituent group; $R_{13}$ and $R_{14}$ may be the same or different and each represents a hydrogen atom or a substituent group; provided that at least one among $R_{11}$, $R_{12}$, $R_{13}$ and $R_{14}$ is a substituent group); or

[2] a color photographic image forming method as described in the foregoing [1], wherein the photographic material has a total gelatin coverage at most 7.5 g/m$^2$; or

[3] a color photographic image forming method as described in the foregoing [2], wherein the yellow color forming layer has a gelatin coverage at most 1.3 g/m$^2$.

In conventional color photographic materials, a layer containing an oil-soluble hydroquinone derivative is provided as a color stain inhibiting layer between every pair of adjacent emulsion layers for the purpose of preventing color stains from generating in the course of development processing. An ultraviolet absorbent is further incorporated in layers provided on both upper and lower sides of a cyan color-forming silver halide emulsion layer in order to improve the image keeping quality. In the special case of a color photographic paper with a high chloride content, each of the light-insensitive layers situated on upper and lower sides of a cyan color-forming silver halide emulsion layer contains both an oil-soluble hydroquinone derivative and an ultraviolet absorbent coextensively.

In the present invention, on the other hand, a color photographic material containing a pyrazoloazole type magenta coupler and having a high chloride content is designed, contrary to convention, so that it does not contain in a substantial sense an oil-soluble hydroquinone derivative on the upper side of the cyan color-forming silver halide emulsion layer and so that it does not contain in a substantial sense an ultraviolet absorbent on the lower side of the cyan color-forming silver halide emulsion layer. Such a material may be subjected to rapid processing. Thus, it becomes feasible to effectively achieve the object of the present invention.

DETAILED DESCRIPTION OF THE INVENTION

The terms "light-sensitive" and "light-insensitive" as used herein are intended to include responsiveness to light from the visible to the infrared regions of electromagnetic waves.

The expression "provided at the position underneath the cyan coupler-containing silver halide emulsion layer" as used herein includes embodiments in which a light-insensitive layer containing a compound of general formula (I) is provided below (i.e., on the support side of) the emulsion layer via a thin light-insensitive hydrophilic layer (to which a coupler and other additives may be added). It preferably includes embodiments in which a light-insensitive layer containing the compound of the general formula (I) is provided directly on the back side of said emulsion layer without such a thin layer therebetween.

The term "below" in reference to a layer indicates the side of the layer in the direction of the support. The term "above" in reference to a layer indicates the side of the layer away from the support.

The color photographic light-sensitive material of this invention comprises a support having thereon at least one yellow color-forming silver halide emulsion layer, at least one magenta color-forming silver halide emulsion layer, and at least one cyan color-forming silver halide emulsion layer.

In general, the yellow color-forming silver halide emulsion layer, the magenta color-forming silver halide emulsion layer and the cyan color-forming silver halide emulsion layer are coated on a support in that order. Color reproduction according to the subtractive color process can be effected by incorporating into the combinations of silver halide emulsions having sensitivities in their respective wavelength regions, so-called color couplers which can form dyes bearing a complementary color relationship to the colored lights by which their corresponding emulsions are respectively sensitized (that is, a yellow dye to blue light, a magenta dye to green light and a cyan dye to red light, in the foregoing light-sensitive emulsion layers, respectively). However, different correspondences of the sensitive layers to the developed hues of couplers may be adopted.

Silver halides used in the silver halide emulsions of this invention are silver chloride, and silver chlorobromide and chloroiodobromide having a chloride content of at least 90 mol %. An iodide content therein is not more than 1 mol %, preferably not more than 0.2 mol %.

As for the halide composition of each emulsion, each emulsion grain may be different from or the same as every other in halide composition. However, it is easy to render emulsion grains uniform in their properties by the use of such an emulsion which has the same halide composition among the emulsion grains.

As for the halide distribution inside the silver halide emulsion grains, one may use grains which are uniform throughout in halide composition, that is to say, have a uniform structure; grains which differ in halide composition between the inner part (core) and the core-surrounding part (shell constructed by one or more of a layer), that is to say, have a layer structure; or grains which contain parts differing in halide composition inside or at the surface thereof without taking a layer form (e.g., have a structure such that the different parts are present at edges, corners or faces in a fused condition when they are present at the grain surface) depending on their intended purpose. For the purpose of achieving high sensitivity, it is more advantageous to use the grains of either of the latter two types than to use the grains having a uniform structure. Further, the grains of latter two types are favored because of their pressure resistance property. When the grains have an non-uniform structure as described above, a boundary between the parts differing in halide composition may have a clear interface, or may be rendered obscure by forming mixed crystals depending on the difference in halide composition. Also, a continuous change in structure may occur in the boundary region.

Because a silver halide emulsion having a high chloride content, or a so-called high chloride content emulsion, is used to advantage in producing a light-sensitive material suitable for rapid processing, emulsions having a chloride content of at least 90 mol % are used in the present invention. To greater advantage, emulsions having a chloride content higher than 90 mol % can be used. A more preferable chloride content in the emulsions of the present invention is at least 95 mol %, particularly at least 98 mol %.

It is desirable that the foregoing high chloride content emulsion have, as described above, a structure such that silver bromide-localized phases are present inside or/and at the surface of the grains with or without assuming a layer form. In the localized phases, the bromide content should be at least 10 mol %, preferably more than 20 mol %. Such localized phases can be present inside the grains, or at the edges, corners or faces of the grain surface, especially at the corners of each grain.

On the other hand, it is also favored to use grains whose halide composition has a distribution which is almost uniform throughout, that is to say, a uniform structure for the purpose of inhibiting to the greatest extent possible a drop in sensitivity from occurring when pressure is imposed on the sensitive material.

The average size of the silver halide grains contained in the silver halide emulsions used in this invention (the grain size herein refers to the diameter of the circle having the same area as the projected area of the grain, and the number average is taken in expressing the grain size) ranges preferably from 0.1 to 2 μm.

As for the-distribution of sizes among grains, so-called monodisperse emulsions which have a variation coefficient (the value obtained by dividing the standard deviation of grain size distribution by the average grain size) of at most 20%, desirably at most 15%, are preferred. For the purpose of obtaining a wide latitude, it is advantageous to coat a blend of some monodisperse emulsions differing in average grain size in a single layer, or to coat them separately in multiple layers.

The silver halide grains contained in the present photographic emulsions may have a regular crystal form, such as that of a cube, a tetradecahedron or an octahedron; an irregular crystal form, such as that of a sphere, a plate or so on; or a composite form thereof. Also, there may be a mixture of silver halide grains having various crystal forms. It is desirable in the present invention that a proportion of silver halide grains having such a regular crystal form as described above to all silver halide grains present in each photographic emulsion be at least 50 mol %, preferably at least 70 mol %, and more preferably at least 90 mol %.

Also, it is desirable in this invention to use such an emulsion which contains tabular silver halide grains having an average aspect ratio (a ratio of a projected area diameter to a thickness) of at least 5, preferably at least 8, in a proportion of more than 50%, based on the projected area, to the whole silver halide grains present therein.

The emulsions of the present invention can be prepared using various methods as described in, for example, P. Glafkides, *Chemie et Phisique Photographique,* Paul Montel, Paris (1967); G. F. Duffin, *Photographic Emulsion Chemistry,* The Focal Press, London (1966), V. L. Zelikman et al, *Making and Coating Photographic Emulsion,* The Focal Press, London (1964); and so on. Specifically, any processes including an acid process, a neutral process and an ammoniacal process, may be employed.

Suitable methods for reacting a water-soluble silver salt with a water-soluble halide include, e.g., a single jet method, a double jet method, or a combination thereof. Also, a method in which silver halide grains are produced in the presence of excess silver ion (the so-called reverse mixing method) can be employed. On the other hand, the so-called controlled double jet method, in which the pAg of the liquid phase in which silver halide grains are to be precipitated is maintained constant, may be also employed. According to this method, a silver halide emulsion having a regular crystal form and an almost uniform distribution of grain sizes can be obtained.

In a process of producing silver halide grains or allowing the produced silver halide grains to ripen physically, various kinds of polyvalent metal ion impurities can be introduced for the purposes of heightening the sensitivity and making improvements in reciprocity low failure characteristics, dependencies on temperature and humidity at the .time of exposure, keeping quality of latent images, and so on. Examples of compounds suitable for the foregoing purposes, include cadmium salts, zinc salts, lead salts, copper salts, thallium salts, and single or complex salts of Group VIII elements such as iron, ruthenium, rhodium, palladium, osmium, iridium, platinum, etc. In particular, the salts of Group VIII elements are used to advantage. Amounts of these compounds to be added, though they can be varied over a wide range depending on the purpose, are preferably within the range of $10^{-9}$ to $10^{-2}$ mole per mole of silver halide.

The silver halide emulsions to be used in the present invention are, in general, chemically and spectrally sensitized.

Chemical sensitization can be effected using a sulfur sensitization process represented by the addition of an unstable sulfur compound, a selenium sensitization process, a sensitization process utilizing a noble metal compound represented by a gold compound and a reduction sensitization process, either individually or in a combination of two or more thereof.

Spectral sensitization is carried out for the purpose of imparting spectral sensitivities in a desired wavelength region of light to an emulsion constituting each light-sensitive layer of the present photographic material. It is preferred in the present invention to effect spectral sensitization by addition of dyes capable of absorbing light in the wavelength region corresponding to desired spectral sensitivities, that is to say, spectral sensitizing dyes. Spectral sensitizing dyes which can be used for the above-described purpose include those described, e.g., in F. M. Harmer, *Heterocyclic compound—Cyanine dyes and related compounds,* John Wiley & Sons, New York and London (1964). Specific examples of compounds and spectral sensitization processes which can be employed to advantage in the present invention include those disclosed in JP-A-62-215272, from the right upper column on the page 22 to the page 38.

The silver halide emulsions to be used in the present invention can contain a wide variety of compounds or precursors thereof for the purpose of preventing fog or stabilizing photographic functions during production, storage, or photographic processing. Specific examples of such compounds which can be preferably used in the present invention include those disclosed in the above-cited patent, JP-A-62-215272, from the page 39 to the page 72.

In the present invention, either a silver halide emulsion of the kind which forms a latent image predominantly at the surface of the grains, or an emulsion of the kind which mainly forms a latent image inside the grains, may be employed.

As for the gelatin used in the present invention, demineralized gelatins are preferable. In general, gelatins contain calcium ion in various quantities. The quantity of calcium ion contained therein is at least 5,000 ppm in many cases. It is desirable for the present invention that gelatins used should contain calcium ion in a quantity below 5,000 ppm. The proportion of demineralized gelatins to all the gelatins used is preferably at least 10 wt %, more preferably at least 20 wt %, and particularly preferably at least 50 wt %. The demineralized gelatins may be used in any constituent layer.

The total coverage of gelatins is preferably at most 7.5 g/m$^2$, more preferably at most 7.2 g/m$^2$, and particularly preferably at most 7.0 g/m$^2$.

Increasing the total coverage of gelatins is undesirable because of the unevenness which arises from the use of a developing solution at a reduced replenishment rate adopted in the present invention.

The compounds used in the present invention, which are represented by general formula (I), are those generally used as color stain inhibitors in photographic light-sensitive materials. It is desirable that these compounds be soluble in oil. The content of the compound represented by general formula (I) in the present light-insensitive layer provided underneath the cyan coupler-containing layer is within the range of 10 mg to 400 mg, preferably 10 mg of 240 mg, per square meter. The amount indicated by the expression "substantial absence" of the compound of the general formula (I) in the ultraviolet absorbent-containing layer provided above the cyan coupler-containing layer is preferably less than 10 mg per square meter. In particular, it is advantageous that the amount is absolutely zero.

In the compounds represented by general formula (I), suitable examples of the substituent groups represented by $R_{11}$ and $R_{12}$ respectively include an alkyl group, an alkenyl group, an aryl group, an acyl group, a cycloalkyl group, a sulfonic acid group, a halogen atom and a heterocyclyl group.

As for the alkyl group cited above, methyl, ethyl, n-propyl, n-butyl, t-butyl, n-amyl, i-amyl, n-octyl, n-dodecyl, n-octadecyl are examples thereof. In particular, those containing 1 to 32 carbon atoms are preferred. As for the alkenyl group cited above, allyl, octenyl and oleyl groups are examples thereof. In particular, those containing 2 to 32 carbon atoms are preferred. As for the aryl group cited above, phenyl and naphthyl groups are examples thereof. As for the acyl group preferably having from 2 to 32 carbon atoms cited above, acetyl, octanoyl and lauroyl groups are examples thereof. As for the halogen atom cited above, fluorine, chlorine and bromine atoms are examples thereof. As for the cycloalkyl group cited above, a cyclohexyl group is an example thereof. As for the heterocyclyl group cited above, imidazolyl, furyl, pyridyl, triazinyl and thiazolyl groups are examples thereof.

In general formula (I), it is desirable that the total number of carbon atoms contained in the substituent groups represented by $R_{11}$ and $R_{12}$ be at least 8. What is more, $R_{11}$ and/or $R_{12}$ should represent a group capable of rendering the compound nondiffusible.

Examples of the substituent groups represented by $R_{13}$ and $R_{14}$ respectively in the foregoing general formula (I) include a halogen atom, an alkyl group, an aryl group, a cycloalkyl group, an alkoxy group, an aryloxy group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group and an arylacyloxy group.

Specific examples of the halogen atom, alkyl group, aryl group, acyl group and cycloalkyl group represented by $R_{13}$ and $R_{14}$ in the foregoing general formula (I) are the same as those given for the groups represented by $R_{11}$ and $R_{12}$. Similarly, the ranges of the number of carbon atoms for the substituents represented by $R_{11}$ and $R_{12}$ are also applicable to the substituents represented by $R_{13}$ and $R_{14}$.

As for the alkoxy group, methoxy, ethoxy and dodecyloxy groups are examples thereof. As for the aryloxy group, a phenoxy group is an example thereof. As for the alkylthio group, methylthio, n-butylthio and n-dodecylthio groups are examples thereof. As for the arylthio group, a phenylthio group is an example thereof. As for the alkylacylamino group and the arylacylamino group, acetylamino group and benzoylamino group are examples thereof, respectively. As for the alkylcarbamoyl group and the arylcarbamoyl group, methylcarbamoyl group and phenylcarbamoyl group are examples thereof, respectively. As for the alkylsulfonamido group and the arylsulfonamido group, methylsulfonamido group and phenylsulfonamido group are examples thereof, respectively. As for the alkylsulfamoyl group and the arylsulfamoyl group, methylsulfamoyl group and phenylsulfamoyl group are examples thereof, respectively. As for the alkylsulfonyl group and the arylsulfonyl group, methylsulfonyl group and phenylsulfonyl group are examples thereof, respectively. As for the alkyloxycarbonyl group and the aryloxycarbonyl group, methyloxycarbonyl group and phenyloxycarbonyl group are examples thereof, respectively. As for the alkylacyloxy group and the arylacyloxy group, acetyloxy group and benzoyloxy group are examples thereof, respectively.

The above-cited substituent groups each may be further substituted by an alkyl group, an aryl group, an aryloxy group, an alkylthio group, cyano group, an acyloxy group, an alkoxycarbonyl group, an acyl group, a sulfamoyl group, a hydroxy group, a nitro group, an amino group, a heterocycly group or so on.

Specific examples of the compound represented by general formula (I) are illustrated below:

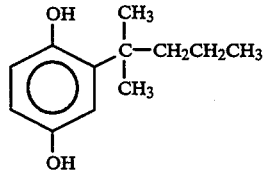

[I-1]

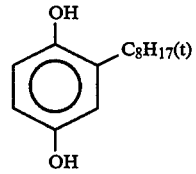

[I-2]

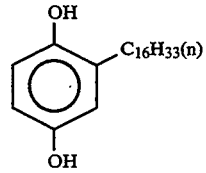

[I-3]

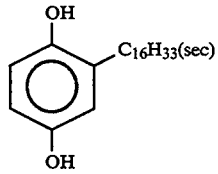

[I-4]

-continued
[I-5]
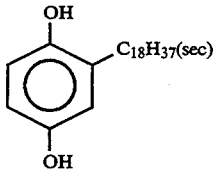
[I-6]
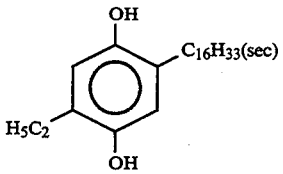
[I-7]
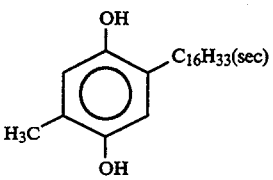
[I-8]
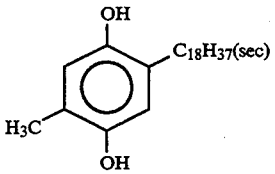
[I-9]
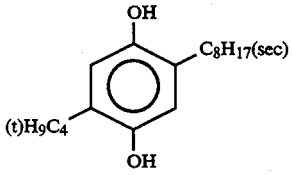
[I-10]
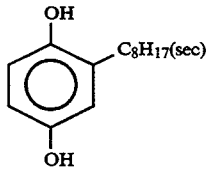
[I-11]
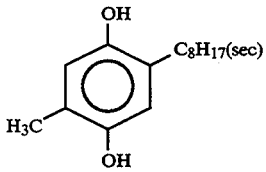
[I-12]
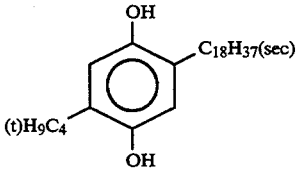
[I-13]
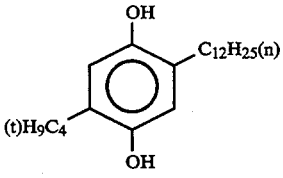
-continued
[I-14]
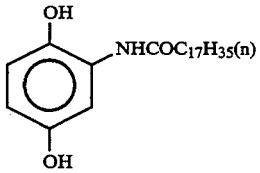
[I-15]
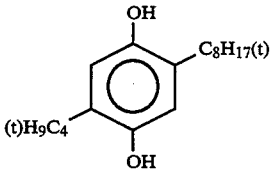
[I-16]
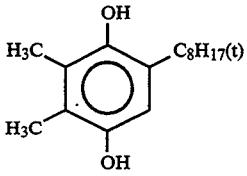
[I-17]
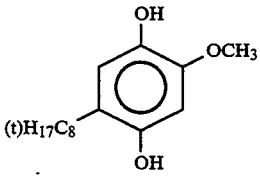
[I-18]
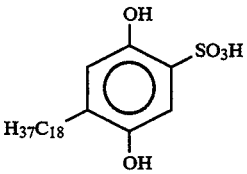
[1-19]
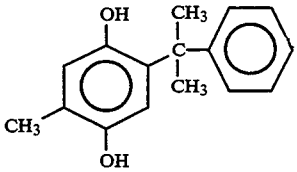
[I-20]
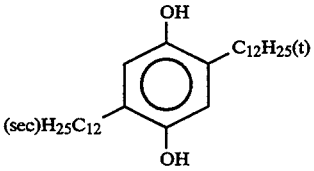
[I-21]
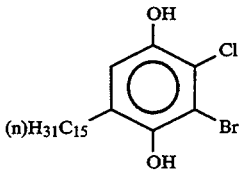
[I-22]
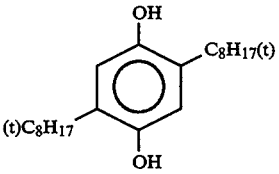

-continued

[I-23]

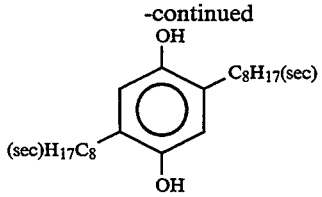

[I-24]

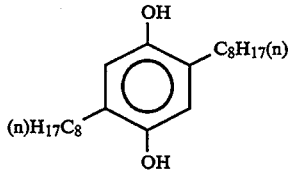

In the light-insensitive layer disposed underneath the cyan coupler-containing layer, it is desirable that at least one compound of the foregoing general formula (I) should be contained in the form of dispersed oil droplets, or in a condition such that it has first been dissolved in a high boiling organic solvent and then emulsified and dispersed. Also, it is advantageous to contain the compound of general formula (I) and a macromolecular compound such as polyacrylamide coextensively.

As for the ultraviolet absorbent located above the cyan coupler-containing layer, on the other hand, any of the known ultraviolet absorbents can be used. Suitable examples thereof include ultraviolet absorbents of the thiazolidone type, the benzotriazole type, the acrylonitrile type, the benzophenone type and the aminobutadiene type. These ultraviolet absorbents are disclosed in U.S. Pat. Nos. 1,023,859, 2,685,512, 2,739,888, 2,784,087, 2,748,021, 3,004,896, 3,052,636, 3,215,530, 3,253,921, 3,533,794, 3,692,525, 3,705,805, 3,707,375, 3,738,837 and 3,754,919, and British Patent 1,321,355.

Of these ultraviolet absorbents, those of the benzotriazole type, especially the 2-(2'-hydroxyphenyl)benzotriazole compounds of general formula (II) illustrated below, are more preferable. These compounds may be in a solid or liquid condition at ordinary temperatures.

Suitable examples of liquid ultraviolet absorbents are described, e.g., in JP-B-55-36984 (the term "JP-B" as used herein means an "examined Japanese patent publication"), JP-B-55-12587 and JP-A-58-214152. Details of the atoms and groups represented by $R_{21}$, $R_{22}$, $R_{23}$, $R_{24}$ and $R_{25}$ in general formula (II) representing the especially preferred ultraviolet absorbents are described, e.g., in JP-A-58-221844,JP-A-59-46646, JP-A-59-109055, JP-B-36-10466, JP-B-42-26187, JP-B-48-5496, JP-B-48-41572, and U.S. Pat. Nos. 3,754,919 and 4,220,711.

Some of the specific examples of the compounds represented by general formula (II) are shown in Table 1. However, the invention should not be construed as being limited to these examples.

General Formula (I)

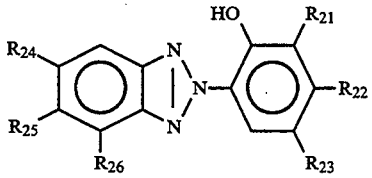

wherein $R^{21}$, $R^{22}$, $R^{23}$, $R^{24}$, $R^{25}$ and $R^{26}$ and may be the same or different and each represents a hydrogen atom, a halogen atom, a nitro group, a hydroxyl group, an alkyl group, an alkenyl group, an aryl group, an alkoxy group, an acyloxy group, an aryloxy group, an alkylthio group, an arylthio group, an aralkylthio group, an alkoxycarbonyl group, a carbamoyl group, an alkylsulfonyl group, a mono or dialkylamino group, an acylamino group, or a 5- or 6-membered heterocyclic ring containing an oxygen or a nitrogen atom and further, $R^{24}$ and $R^{25}$, or $R^{25}$ and $R^{26}$ may combine to form a 5- or 6-membered aromatic carbocyclic ring.

TABLE 1

| UV No. | $R_{24}$ | $R_{25}$ | $R_{22}$ | $R_{21}$ | $R_{23}$ |
|---|---|---|---|---|---|
| | | | (II-a) | | |
| 1 | H | H | H | H | H |
| 2 | H | H | H | H | $CH_3$ |
| 3 | H | H | H | H | (t)$C_4H_9$ |
| 4 | H | H | H | H | (s)$C_5H_{11}$ |
| 5 | H | H | H | H | (t)$C_5H_{11}$ |
| 6 | H | H | H | H | 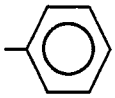 |
| 7 | H | H | H | H | (n)$C_5H_{11}$ |
| 8 | H | H | H | H | (n)$C_8H_{17}$ |
| 9 | H | H | H | H | (i)$C_8H_{17}$ |
| 10 | H | H | H | H | (t)$C_8H_{17}$ |
| 11 | H | H | H | H | (n)$C_{12}H_{25}$ |
| 12 | H | H | H | H | (n)$C_{16}H_{33}$ |
| 13 | H | H | H | H | $OCH_3$ |
| 14 | H | H | H | H | $C_2H_4COOC_8H_{17}$(n) |
| 15 | H | H | H | H | $CONHC_{12}H_{25}$(n) |
| 16 | H | H | H | $CH_3$ | (s)$C_4H_9$ |
| 17 | H | H | H | $CH_3$ | (t)$C_4H_9$ |
| 18 | H | H | H | (s)$C_4H_9$ | (s)$C_4H_9$ |
| 19 | H | H | H | (s)$C_4H_9$ | (t)$C_4H_9$ |
| 20 | H | H | H | (t)$C_4H_9$ | (s)$C_4H_9$ |
| 21 | H | H | H | (t)$C_4H_9$ | (t)$C_4H_9$ |
| 22 | H | H | H | (t)$C_4H_9$ | (s)$C_{12}H_{25}$ |
| 23 | H | H | H | (t)$C_4H_9$ | $C_2H_4COOC_8H_{17}$(n) |

TABLE 1-continued

| UV No. | $R_{24}$ | $R_{25}$ | $R_{22}$ | $R_{21}$ | $R_{23}$ |
|---|---|---|---|---|---|
| 24 | H | H | H | (t)$C_5H_{11}$ | (t)$C_5H_{11}$ |
| 25 | H | H | H | (t)$C_5H_{11}$ | $C_6H_5$ |
| 26 | H | H | H | (t)$C_5H_{11}$ | 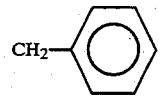 |
| 27 | H | H | H | Cl | Cl |
| 28 | H | H | H | $CH_2NHCOOC_5H_{11}$(n) | H |
| 29 | H | Cl | H | H | (t)$C_5H_{11}$ |
| 30 | H | Cl | H | H | 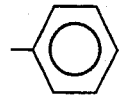 |
| 31 | H | Cl | H | H | $C_6H_{11}$(cycl.) |
| 32 | H | Cl | H | H | $C_2H_4COOC_8H_7$ (i + sec) |
| 33 | H | Cl | H | H | Cl |
| 34 | H | Cl | H | (s)$C_4H_9$ | (s)$C_4H_9$ |
| 35 | H | Cl | H | (s)$C_4H_9$ | (t)$C_4H_9$ |
| 36 | H | Cl | H | (t)$C_4H_9$ | $CH_3$ |
| 37 | H | Cl | H | (t)$C_4H_9$ | $CH_2CH{=}CH_2$ |
| 38 | H | Cl | H | (t)$C_4H_9$ | (s)$C_4H_9$ |
| 39 | H | Cl | H | (t)$C_4H_9$ | (t)$C_4H_9$ |
| 40 | H | Cl | H | (t)$C_4H_9$ | $C_6H_{11}$(cycl.) |
| 41 | H | Cl | H | (t)$C_4H_9$ | $C_2H_4COOC_8H_{17}$ |
| 42 | H | Cl | H | (n)$C_5H_{11}$ | 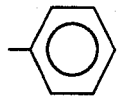 |
| 43 | H | Cl | H | $CH_2N$(t)$C_4H_9$ / $CH_3$ | H |
| 44 | H | $SOOC_2H_5$ | H | $CH_3$ | $CH_3$ |
| 45 | H | $CH_3$ | H | H | (i)$C_8H_{17}$ |
| 46 | H | $CH_3$ | H | H | $OCH_3$ |
| 47 | H | $CH_3$ | H | (s)$C_4H_9$ | (s)$C_4H_9$ |
| 48 | H | $CH_3$ | H | (s)$C_4H_9$ | (t)$C_4H_9$ |
| 49 | H | $CH_3$ | H | (t)$C_5H_{11}$ | 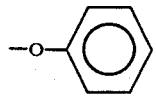 |
| 50 | H | $CH_3$ | H | Cl | (n)$C_8H_{17}$ |
| 51 | H | $C_2H_5$ | H | (i)$C_3H_7$ | (i)$C_3H_7$ |
| 52 | H | (n)$C_4H_9$ | H | (s)$C_4H_9$ | (s)$C_4H_9$ |
| 53 | H | (n)$C_4H_9$ | H | (s)$C_4H_9$ | (t)$C_4H_9$ |
| 54 | H | (n)$C_4H_9$ | H | (s)$C_4H_9$ | (t)$C_5H_{11}$ |
| 55 | H | (s)$C_4H_9$ | H | (t)$C_4H_9$ | (t)$C_4H_9$ |
| 56 | H | (s)$C_4H_9$ | H | (t)$C_4H_9$ | (t)$C_5H_{11}$ |
| 57 | H | (s)$C_4H_9$ | H | (t)$C_4H_9$ | $C_2H_4COOC_8H_{17}$(n) |
| 58 | H | (s)$C_4H_9$ | H | (t)$C_5H_{11}$ | (t)$C_5H_{11}$ |
| 59 | H | (t)$C_4H_9$ | H | (s)$C_4H_9$ | (t)$C_4H_9$ |
| 60 | H | (t)$C_4H_9$ | H | (s)$C_4H_9$ | (t)$C_4H_9$ |
| 61 | H | (t)$C_4H_9$ | H | (s)$C_4H_9$ | (t)$C_5H_{11}$ |
| 62 | H | (t)$C_4H_9$ | H | (t)$C_4H_9$ | (t)$C_4H_9$ |
| 63 | H | (n)$C_5H_{11}$ | H | (s)$C_4H_9$ | (t)$C_4H_9$ |
| 64 | H | (t)$C_5H_{11}$ | H | (s)$C_4H_9$ | (t)$C_4H_9$ |
| 65 | H | (t)$C_5H_{11}$ | H | (t)$C_5H_{11}$ | (t)$C_5H_{11}$ |
| 66 | H | $C_6H_5$ | H | (t)$C_4H_9$ | (t)$C_4H_9$ |
| 67 | H | $C_6H_5$ | H | (t)$C_5H_{11}$ | (t)$C_5H_{11}$ |
| 68 | H | (n)$C_8H_{17}$ | H | H | (i)$C_8H_{17}$ |
| 69 | H | OH | H | (t)$C_4H_9$ | (t)$C_4H_9$ |
| 70 | H | $OCH_3$ | H | H | $OC_8H_{17}$(s) |
| 71 | H | $OCH_3$ | H | (s)$C_4H_9$ | (s)$C_4H_9$ |
| 72 | H | $OCH_3$ | H | (s)$C_4H_9$ | (t)$C_4H_9$ |
| 73 | H | $OCH_3$ | H | (t)$C_5H_{11}$ | (t)$C_5H_{11}$ |

TABLE 1-continued

| UV No. | $R_{24}$ | $R_{25}$ | $R_{22}$ | $R_{21}$ | $R_{23}$ |
|---|---|---|---|---|---|
| 74 | H | $OCH_3$ | H | (t)$C_5H_{11}$ | 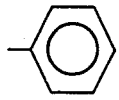 |
| 75 | H | $OCH_3$ | H | Cl | Cl |
| 76 | H | $OC_2H_5$ | H | (s)$C_4H_9$ | (t)$C_4H_9$ |
| 77 | H | $OC_4H_9$(n) | H | Cl | $OCH_3$ |
| 78 | H | 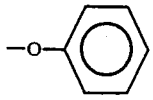 | H | (t)$C_5H_{11}$ | (t)$C_5H_{11}$ |
| 79 | H | $COOC_4H_9$(n) | H | (n)$C_4H_9$ | (t)$C_5H_{11}$ |
| 80 | H | $NO_2$ | H | (n)$C_8H_{17}$ | $OCH_3$ |
| 81 | H | H | Cl | H | Cl |
| 82 | H | H | $OC_5H_{17}$(n) | H | H |
| 83 | H | $CH_3$ | $CH_3$ | H | $CH_3$ |
| 84 | H | Cl | (n)$C_{15}H_{31}$ | H | H |
| 85 | $CH_3$ | $OC_4H_9$(n) | H | H | H |
| 86 | $CH_3$ | $OC_9H_{19}$(n) | H | H | H |
| 87 | $CH_3$ | $OC_{12}H_{25}$(n) | H | H | H |
| 88 | Cl | Cl | H | H | H |
| 89 | $OCH(CH_3)_2$ | Cl | H | H | H |
| 90 | $OCH(CH_3)_2$ | Cl | H | H | $CH_3$ |
| 91 | $OCH(CH_3)_2$ | $OC_2H_3(CH_3)_2$ | H | H | H |
| 92 | $OC_4H_9$(n) | $OC_4H_9$(n) | H | H | H |
| 93 | $OC_4H_9$(n) | $OC_4H_9$(n) | H | H | $OCH_3$ |
| | | | (II-b) | | |
| 94 | H | | | H | $CH_3$ |
| 95 | H | | | H | (t)$C_8H_{17}$ |
| 96 | H | | | (t)$C_4H_9$ | (t)$C_4H_9$ |
| 97 | Cl | | | H | $C_2H_5$ |

($R_{26}$ = H)
[$R_{22}$ = H; $R_{25}$ and $R_{26}$ = moiety completing a benzene ring by combining with each other]

The content of the ultraviolet absorbent in the light-insensitive layer provided above the cyan coupler-containing silver halide light-sensitive emulsion layer is within the range of 150 mg to 1,000 mg, preferably 150 mg of 600 mg, per square meter. It is essential to the present invention that the ultraviolet absorbent is substantially absent from the light-insensitive layer provided underneath the cyan coupler-containing silver halide light-sensitive emulsion layer. The amount indicated by the expression "substantially absent" is less than 150 mg, preferably at most 100 mg, per square meter. In particular, it is advantageous that the amount is absolutely zero. It is also desirable for the stabilization of the cyan dye image that an ultraviolet absorbent be contained in the cyan coupler-containing silver halide light-sensitive emulsion layer.

In addition to the ultraviolet absorbent, the light-insensitive layer provided adjacent to and on the upper side of the cyan coupler-containing layer may contain a stain inhibitor, a stabilizer for the ultraviolet absorbent, and so on. These additives may be incorporated therein in a condition such that they are dissolved in a high boiling organic solvent and dispersed in the form of emulsion.

In the present invention, yellow, magenta and cyan couplers are used which can form yellow, magenta and cyan colors, respectively, by coupling with the oxidation product of an aromatic amine type color developing agent.

As for the magenta coupler, a pyrazoloazole type magenta coupler represented by the foregoing general formula (M) is used in the present invention:

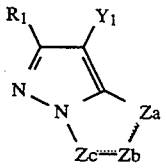

(M)

Among the pyrazoloazole type couplers represented by general formula (M), the imidazo[1,2-b]pyrazoles disclosed in U.S. Pat. No. 4,500,630 are preferred in view of the low yellow side absorption of the developed dyes and light fastness thereof, and the pyrazolo[1,5-b]-[1,2,4]triazoles disclosed in U.S. Pat. No. 4,540,654 are especially favored in that regard. Examples of the substituents $R_1$ and $Y_1$ in formula (M) are referred to from column 2, line 42 to column 8, line 27 of U.S. Pat. No. 4,540,654 above.

In addition, there can be preferably employed pyrazolotriazole type couplers in which the 2-, 3- or 6-position of the pyrazolotriazole ring is substituted by a branched alkyl group, as disclosed in JP-A-61-65245; pyrazoloazole type couplers which contain a sulfonamido group in a molecule, as disclosed in JP-A-61-65246; pyrazoloazole type couplers which contain an alkoxyphenylsulfonamido group as a ballast group, as disclosed in JP-A-61-147254; and pyrazolotriazole type couplers in which the 6-position is substituted by an alkoxy or aryloxy group, as disclosed in European Patents (laid open) 226,849 and 294,785. Of these couplers, a pyrazolo[1,5-b][1,2,4]triazole and pyrazolo[5,1-c][1,2,4]triazole, in which a tert-alkyl group, such as t-butyl group is substituted at 6-position, are preferred.

Specific examples of the compounds represented by general formula (M) which can be preferably used in the present invention are illustrated below:

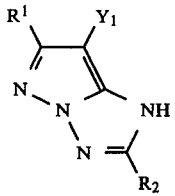
| Compound | $R_1$ | $R_2$ | $Y_1$ |
|---|---|---|---|
| M-9 | $CH_3$— | 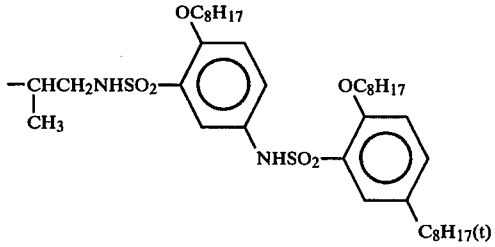 | Cl |
| M-10 | " | 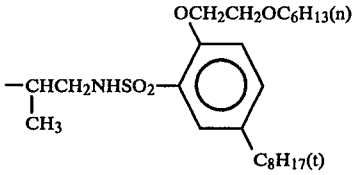 | " |
| M-11 | $(CH_3)_3C$— | 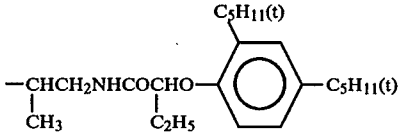 | 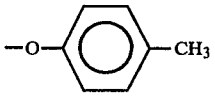 |
| M-12 | 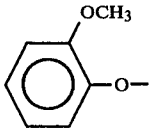 | 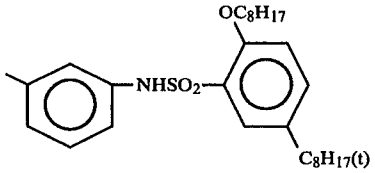 | 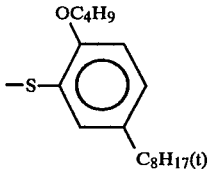 |

-continued
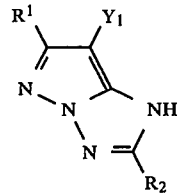
| Compound | $R_1$ | $R_2$ | $Y_1$ |
|---|---|---|---|
| M-13 | $CH_3$— | 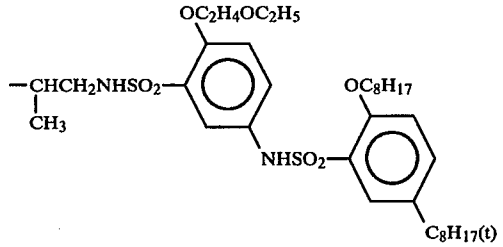 | Cl |
| M-14 | " | 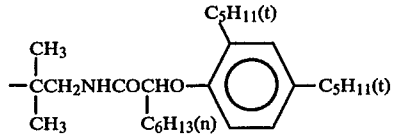 | " |
| M-15 | $CH_3$— | 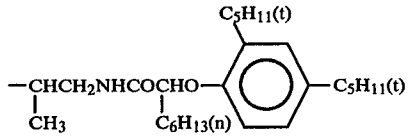 | Cl |
| M-16 | " | 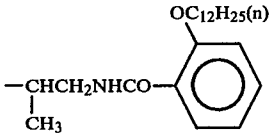 | " |
| M-17 | " | 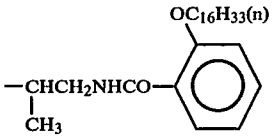 | " |

-continued
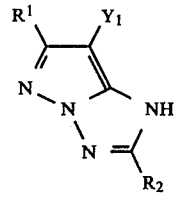
| Compound | $R_1$ | $R_2$ | $Y_1$ |
|---|---|---|---|
| M-18 | 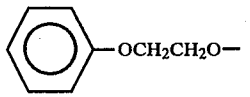 | 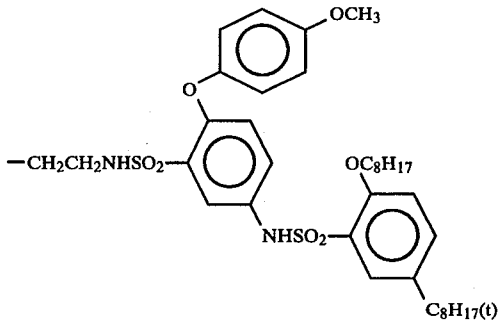 | 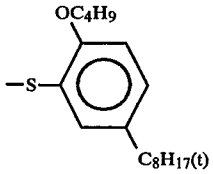 |
| M-19 | $CH_3CH_2O-$ | " | " |
| M-20 | 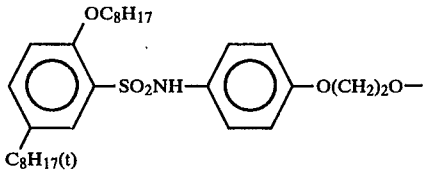 | 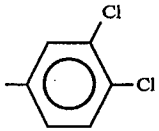 | 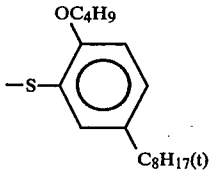 |
| M-21 | 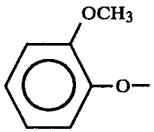 | 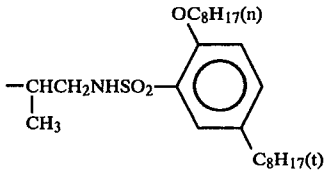 | Cl |

-continued
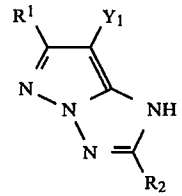
| Compound | $R_1$ | $R_2$ | $Y_1$ |
|---|---|---|---|
| M-22 | $CH_3-$ | 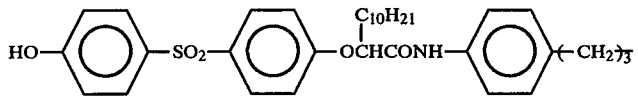 | Cl |
| M-23 | " | 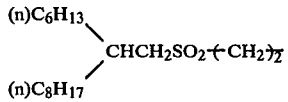 | " |
| M-24 | 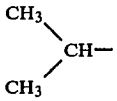 | 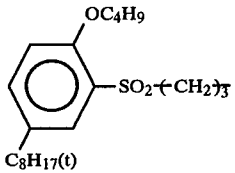 | " |
| M-25 | 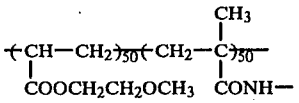 50/50 (mol) | 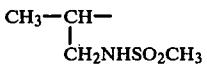 | " |
| M-26 | 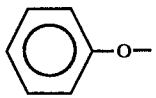 | 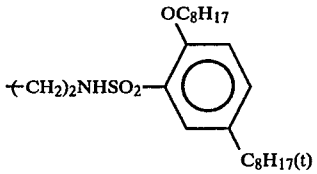 | Cl |

-continued
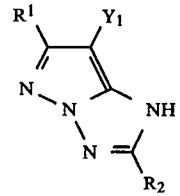
| Compound | $R_1$ | $R_2$ | $Y_1$ |
|---|---|---|---|
| M-27 | $CH_3$— | 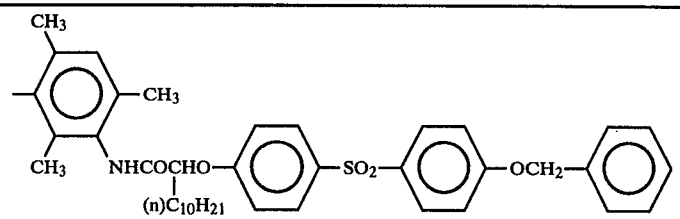 | " |
| M-28 | $(CH_3)_3C$— | 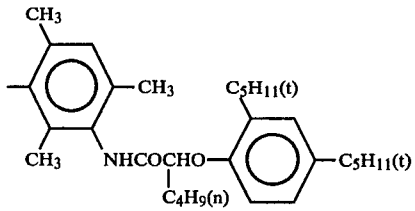 | " |
| M-29 | 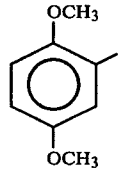 | 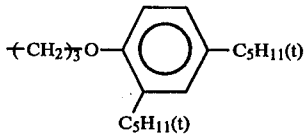 | Cl |
| M-30 | $CH_3$— | $-CH(C_2H_5)-N(C_{18}H_{37})COCH_2CH_2COOH$ | " |
| M-31 | $(CH_3)_3C$— | $-(CH_2)_3SO_2C_{12}H_{25}(n)$ | " |

In the magenta color-forming layer of the present invention, other magenta color-forming couplers can also be used together with the foregoing, provided that they do not lessen the effect of the present invention.

For the purpose of enhancement of image sharpness and the like, it is desirable (i) that dyes capable of undergoing decolorization by photographic processing (especially oxonol dyes), which are disclosed at pages 27 to 76 in EP-A2-0337490, be added to a hydrophilic colloid layer of the present photographic material in such an amount as to impart an optical reflection density of at least 0.70 at 680 nm to the resulting photographic material, and (ii) that titanium oxide grains which have undergone surface treatment with a di- to tetrahydric alcohol (e.g., trimethylolethane) should be incorporated in a content of at least 12 wt % (more preferably at least 14 wt %) in a waterproof resin coat are provided on the support of the present photographic material.

Photographic additives which can be used in the present invention, including cyan, magenta and yellow couplers, are preferably dissolved in a high boiling organic solvent, and then incorporated into the photographic material. Such a high boiling organic solvent is a water-immiscible compound having a melting point of 100° C. or lower and a boiling point of 140° C. or higher and a good solvent for couplers. The melting point of preferable high boiling organic solvents is 80° C. or lower and the boiling point thereof is 160° C. or higher, more preferably 170° C. or higher.

Details of such high boiling organic solvents are described in JP-A-62-215272, from the right lower column at page 137 to the right upper column at page 144.

On the other hand, a loadable latex polymer (as disclosed, e.g., in U.S. Pat. No. 4,203,716) impregnated with a cyan, magenta or yellow coupler in the presence or absence of a high boiling organic solvent as described above, or such a coupler dissolved in a high boiling organic solvent together with a polymer insoluble in water but soluble in an organic solvent, can be dispersed into a hydrophilic colloid solution in an emulsified condition.

Polymers which can be preferably used therein include the homo- or copolymers disclosed in U.S. Pat. No. 4,857,449, from column 7 to column 15, and WO 88/00723, from page 12 to page 30. In particular, polymers of methacrylate or acrylamide type, especially those of acrylamide type, are favored over others with respect to color image stabilization and so on.

In addition, it is desirable that the compounds for improving the keeping quality of dye images as disclosed in EP-A2-0277589 should be used together with the couplers in the photographic material of the present invention.

That is, compounds of the kind which can produce chemically inert, substantially colorless compounds by combining chemically with an aromatic amine developing agent remaining after the color development-processing and/or compounds of the kind which can produce chemically inert, substantially colorless compounds by combining chemically with the oxidized aromatic amine developing agent remaining after the color development-processing are preferably used in combination or independently. By the use of these compounds, the generation of stains, which are due to the formation of dyes through the reaction between the couplers and the unoxidized or oxidized color developing agent remaining in the processed photographic film, and the occurrence of other side reactions upon storage after photographic processing, can be inhibited effectively.

Also, it is desirable that the antimolds disclosed in JP-A-63-271247 be added to the photographic material of the present invention in order to prevent the deterioration of images from occurring through propagation of various kinds of molds and bacteria in hydrophilic colloid layers.

As for the support of the present photographic material, a support of the white polyester type or a support provided with a white pigment-containing layer on the same side as the silver halide emulsion layers may be adopted for display use. Also, it is desirable for improving sharpness that an antihalation layer be provided on the emulsion layer side or the reverse side of the support. In particular, it is desired that the transmission density of the support should be adjusted to the range of 0.35 to 0.8 so that a display may be enjoyed by means of both transmitted and reflected light.

The photographic material of the present invention may be exposed to either visible or infrared rays. For the exposure, not only low intensity exposure but also high intensity short-time exposure may be employed. In the latter case, a laser scanning exposure system in which the exposure time per picture element is shorter than $10^{-4}$ second is preferred in particular.

Upon exposure, it is preferable to use the band stop filter disclosed in U.S. Pat. No. 4,880,726. This filter can get rid of color stain of optical origin to improve color reproducibility to a great extent.

As for the silver halide emulsions and other ingredients (such as additives, etc.) and the photographic constituent layers (including their order of arrangement), those disclosed in the following patent specifications, especially EP-A2-0355660 (corresponding to JP-A-02-139544) can be preferably applied to the photographic materials used in the present invention.

| Photographic Constituents | JP-A-62-215272 | JP-A-02-33144 | EP-A2-0355660 |
|---|---|---|---|
| Silver halide emulsions | from 6th line in right upper column at page 10 to 5th line in left lower column at page 12, and from 4th line from the bottom of right lower column at page 12 to 17th line in left upper column at page 13 | from 16th line in right upper column at page 28 to IIth line in right lower column at page 29, and from 2nd line to 5th line at page 30 | from 53th line at page 45 to 3rd line at page 47, and from 20th line to 22nd line at page 47 |
| Silver halide solvents | from 6th line to 14th line in left lower column at page 12, and from 3rd line | | |

-continued

| Photographic Constituents | JP-A-62-215272 | JP-A-02-33144 | EP-A2-0355660 |
|---|---|---|---|
| | from the bottom of left upper column at page 13 to the end line in left lower column at page 18 | | |
| Chemical sensitizers | from 3rd line in left lower column to 5th line in right lower column at page 12, and from 1st line in right lower column at page 18 to 9th line from the bottom of right upper column at page 22 | from 12th line to end line in right lower column at page 29 | from 4th line to 9th line at page 47 |
| Spectral sensitizers (Spectral sensitizing methods) | from 8th line from the bottom of right upper column at page 22 to end line at page 38 | from 11th to 13th in left upper column at page 30 | from 10th line to 15th line at page 47 |
| Emulsion stabilizer | from 1st line in left upper column at page 39 to end line in right upper column at page 72 | from 14th line in left upper column to 1st line in right upper column at page 30 | from 16th line to 19th line at page 47 |
| Development accelerator | from 1st line in left lower column at page 72 to 3rd line in right upper column at page 91 | | |
| Color couplers (cyan, magenta and yellow couplers) | from 4th line in right upper column at page 91 to 6th line in left upper column at page 121 | from 14th line in right upper column at page 3 to end line in left upper column at page 18, and from 6th line in right upper column at page 30 to 11th line in right lower column at page 35 | from 15th line to 27th line at page 4, from 30th line at page 5 to end line at page 28, from 29th line to 31st line at page 45, and from 23rd line at page 47 to 50th line at page 63 |
| Color formation reinforcing agent | from 7th line in left upper column at [age 121 to 1st line in right upper column at page 125 | | |
| Ultraviolet absorbent | from 2nd line in right upper column at page 125 to end line in left lower column at page 127 | from 14th line in right lower column at page 37 to 11th line in left upper column at page 38 | from 22nd line to 31st line at page 65 |
| Discoloration inhibitor (image stabilizer) | from 1st line in right lower column at page 127 to 8th line in left lower column at page 137 | from 12th line in right upper column at page 36 to 19th line in left upper column at page 37 | from 30th line at page 4 to 23rd line at page 5, from 1st line at page 29 to 25th line at page 45, from 33rd line to 40th line at page 45, and from 2nd line to 21st line at page 65 |
| High boiling and/or low boiling organic solvents | from 9th line in left lower column at page 137 to end line in right upper column at page 144 | from 14th line in right lower column at page 35 to 4th line in left upper column at page 36 | from 1st line to 51st line at page 64 |
| Dispersion methods for photographic additives | from 1st line in left lower column at page 144 to 7th line in right upper column at page 146 | from 10th line in right lower column at page 27 to end line in left upper column at page 28, and from 12th line in right lower column at page 35 to 7th line in right upper column at page 36 | from 51st line at page 63 to 56th line at page 64 |
| Hardeners | from 8th line in right upper column at page 146 to 4th line in left lower column at page 155 | | |

-continued

| Photographic Constituents | JP-A-62-215272 | JP-A-02-33144 | EP-A2-0355660 |
|---|---|---|---|
| Precursors of developing agents | from 5th line in left lower column at page 155 to 2nd line in right lower column at page 155 | | |
| Deveippment inhibitor releasing compounds | from 3rd line to 9th line in right lower column at page 155 | | |
| Supports | from 19th line in right lower column at page 155 to 14th line in left upper column at page 156 | from 18th line in right upper column at page 38 to 3rd line in left upper column at page 39 | from 29th line at page 66 to 13th line at page 67 |
| Light-sensitive layer structures | from 15th line in left upper column at page 156 to 14th line in right lower column at page 156 | from 1st line to 15th line in right upper column at page 28 | from 41st line to 52nd line at page 45 |
| Dyes | from 15th line in right lower column at page 156 to end line in right lower column at page 184 | from 12th line in left upper column to 7th line in right upper column at page 38 | from 18th line to 22nd line at page 66 |
| Color stain inhibitors | from 1st line in left upper column at page 185 to 3rd line in right lower column at page 188 | from 8th line to 11th line in right upper column at page 36 | from 57th line at page 64 to 1st line at page 65 |
| Tone modifiers | from 4th line to 8th line in right lower column at page 188 | | |
| Stain inhibitors | from 9th line in right lower column at page 188 to 10th line in right lower column at page 193 | from end line in left upper column to 13th line in right lower column at page 37 | from 32nd line at page 65 to 17th line at page 66 |
| Surfactants | from 1st line in left lower column at page 201 to end line in right upper column at page 210 | from 1st line in right upper column at page 18 to end line in right lower column at page 24, and from 10th line from the bottom of left lower column to 9th line in right lower column at page 27 | |
| Fluorine-containing compounds (antistatic agents, coating aids, lubricants, adhesion inhibitors, etc.) | from 1st line in left lower column at page 210 to 5th line in left lower column at page 222 | from 1st line in left upper column at page 25 to 9th line in right lower column at page 27 | |
| Binders (hydrophilic colloids) | from 6th line in left lower column at page 222 to end line in left upper column at page 225 | from 8th line to 18th line in right upper column at page 38 | from 23rd line to 28th line at page 66 |
| Thickening agents | from 1st line in left lower column at page 225 to 2nd line in right upper column at page 227 | | |
| Antistatic agents | from 3rd line in right upper column at page 227 to 1st line in left upper column at page 230 | | |
| Polymer latexes | from 2nd line in left upper column at page 230 to end line at page 239 | | |
| Matting agents | from 1st line in left upper column to end line in right upper column at page 240 | | |

Note)
The quoted paragraphs of JP-A-62-21527 are intended to include the contents of amendments dated March 16 in 1987 which were given in the end of the bulletin.

As for the yellow couplers, the so-called blueshift couplers disclosed in JP-A-63-231451, JP-A-63-123047, JP-A-63-241547, JP-A-01-173499, JP-A-01-213648 and JP-A-01-250944 are preferably used in addition to those cited in the above references.

As for the cyan couplers, not only diphenylimidazole type cyan couplers disclosed in JP-A-02-33144 but also 3-hydroxypyridine type cyan couplers disclosed in EP-A2-033185 (especially one which is prepared by introducing a chlorine atom as a splitting-off group into Coupler (42) cited as a specific example to render the coupler two-equivalent, and Couplers (6) and (9) cited as specific examples) and cyclic active methylene type cyan couplers disclosed in JP-A-64-32260 (especially Couplers 3, 8 and 34 cited as specific examples) are preferably used in addition to those cited in the above references.

The color photographic light-sensitive materials of the present invention are preferably subjected to color development, bleach-fix and washing (or stabilization) operations. However, bleach and fixation steps may not be carried out with a monobath, but they may be carried out separately.

It is desirable that photographic processing from color development to washing (or stabilization) step be performed within 4 minutes, preferably within 3 minutes.

The color developer to be used in the present invention contains a known aromatic primary amine color developing agent. Those preferred as such a color developing agent include p-phenylenediamine derivatives. Typical representatives of p-phenylenediamine derivatives are described below. However, the invention should not be construed as being limited to these compounds.

| | |
|---|---|
| D-1 | N,N-diethyl-p-phenylenediamine, |
| D-2 | 2-amino-5-diethylaminotoluene, |
| D-3 | 2-amino-5-(N-ethyl-N-laurylamino)toluene, |
| D-4 | 4-[N-ethyl-N-(β-hydroxyethyl)amino]aniline, |
| D-5 | 2-methyl-4-[N-ethyl-N-(β-hydroxyethyl)-amino]aniline, |
| D-6 | 4-amino-3-methyl-N-ethyl-N-[β-(methane-sulfonamido)ethyl]aniline, |
| D-7 | N-(2-amino-5-diethylaminophenylethyl)-methanesulfonamide, |
| D-8 | N,N-dimethyl-p-phenylenediamine, |
| D-9 | 4-amino-3-methyl-N-ethyl-N-methoxyethyl-aniline, |
| D-10 | 4-amino-3-methyl-N-ethyl-N-6-ethoxyethyl-aniline, |
| D-11 | 4-amino-3-methyl-N-ethyl-N-8-butoxyethyl-aniline. |

Among the above-cited p-phenylenediamine derivatives, 4-amino-3-methyl-N-ethyl-N-[B-(methanesulfonamido)ethyl]aniline (D-6) is particularly favored over the others.

These p-phenylenediamine derivatives may assume the form of salt, such as that of sulfate, hydrochloride, sulfite or p-toluenesulfonate. The suitable amount of the aromatic primary amine developing agent to be added is from about 0.1 g to about 20 g, preferably from about 0.5 g to about 10 g, per 1 l of developer.

In performing the present invention, it is desired that the developer used not contain benzyl alcohol in a substantial sense. The expression "not contain benzyl alcohol in a substantial sense" used herein is intended to include cases in which benzyl alcohol is contained in a concentration of 2 ml/l or less, more preferably 0.5 ml/l or less. In the most preferred case, benzyl alcohol is not contained at all.

Further, it is desirable that the developer used in the present invention not contain, in a substantial sense, sulfite ion. The sulfite ion has not only a function as preservative for a developing agent but also has such effects as dissolving silver halides and lowering the dye-forming efficiency by a reaction with an oxidized developing agent. These effects are presumed to be responsible in part for an increase in the fluctuation of photographic characteristics, which is incidental to the continuous processing. The expression "not contain in substantial sense" as used herein means that sulfite ion may be present in a concentration of $3.0\times10^{-3}$ mol/l or less and, more preferably, sulfite ion is not contained at all. In the present invention, however, a slight quantity of sulfite ion used as an antioxidant for a processing kit, in which a developing agent is concentrated prior to practical use, is excepted from the foregoing restriction.

It is desired, as described above, that the developer used in the present invention not contain, in a substantial sense, sulfite ion, and it is more desirable that the developer not contain, in a substantial sense, hydroxylamine also. This is because the variation in hydroxylamine concentration is supposed to have a great influence upon photographic characteristics since hydroxylamine itself has an activity in silver development, as well as functioning as a preservative. The expression "not contain hydroxylamine in a substantial sense" as used herein is intended to include cases where hydroxylamine has a concentration of $5.0\times10^{-3}$ mol/l or less. In particular, the case where hydroxylamine is not contained at all is preferred.

It is much more desirable that the developer used in this invention should contain organic preservatives in place of the above-described hydroxylamine and sulfite ion.

The term organic preservative as used herein refers to all organic compounds which can decrease the deterioration speed of the aromatic primary amine color developing agents when added to a processing solution for color photographic materials. More specifically, such compounds include those having the function of preventing color developing agents from suffering aerial oxidation or the like. Examples of especially effective organic preservatives include hydroxylamine derivatives (excepting hydroxylamine itself), hydroxamic acids, hydrazines, hydrazides, phenols, α-hydroxyketones, α-aminoketones, sugars, monoamides, diamines, polyamines, quaternary ammonium salts, nitroxy radicals, alcohols, oximes, diamide compounds, condensed ring type amines and the like. Specific examples of these preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020, JP-B-48-30496, and so on.

As other preservatives, various metals disclosed in JP-A-57-44148 and JP-A-57-53749, salicylic acids disclosed in JP-A-59-180588, alkanolamines disclosed in JP-A-54-3532, polyethyleneimides disclosed in JP-A-56-94349, aromatic polyhydroxy compounds disclosed in U.S. Pat. No. 3,746,544, and so on may be added, if needed. In particular, the addition of alkanolamines such as triethanolamine, dialkylhydroxylamines such as diethylhydroxylamine, hydrazine derivatives or aromatic polyhydroxy compounds is favored.

Among the above-cited organic preservatives, hydroxylamine derivatives and hydrazine derivatives (including hydrazines and hydrazides) are particularly preferred over others, and the details of these derivatives are described in JP-A-1-97953, JP-A-1-186939, JP-A-1-186940 and JP-A-1-187557, and so on.

Furthermore, the combined use of the above-described hydroxylamine or hydrazine derivatives and amines is of greater advantage in view of the enhancement of stability of the color developer and, what is more, the enhancement of steadiness during continuous processing.

Examples of amines to be used for the foregoing purpose include cyclic amines as disclosed in JP-A-63-39447, amines as disclosed in JP-A-63-128340, and other amines as disclosed in Japanese Patent Application Nos. 63-9713 and 63-11300.

It is desirable in the present invention that the color developer should contain chlorine ion in a concentration of from $3.5\times10^{-2}$ to $1.5\times10^{-1}$ mol/l, and particularly preferably from $4\times10^{-2}$ to $1\times10^{-1}$ mol/l. When the chlorine ion concentration is increased beyond $1.5\times10^{-1}$ mol/l, the chlorine ion retards development. Therefore, such a high chlorine ion concentration is undesirable with respect to rapid attainment of high maximum density, which is one of the objects of this invention. On the other hand, chlorine ion concentrations less than $3.5\times10^{-2}$ mol/l are undesirable from the viewpoint of prevention of fog.

It is also desirable in this invention that the color developer contain bromine ion in a concentration of from $3.0\times10^{-5}$ to $1.0\times10^{-3}$ mol/l, preferably from $5.0\times10^{-5}$ to $5\times10^{-4}$ mol/l. When the bromine ion concentration is higher than $1\times10^{-3}$ mol/l, development is retarded, and further the maximum density and the sensitivity are lowered, whereas when it is lower than $3.0\times10^{-5}$ mol/l generation of fog cannot be prevented satisfactorily.

Herein, chlorine ion and bromine ion may be added directly to the developer, or eluted from light-sensitive materials with the developer during development-processing.

In case of direct addition to the color developer, substances which can be used to supply chlorine ion include sodium chloride, potassium chloride, ammonium chloride, lithium chloride, nickel chloride, magnesium chloride, manganese chloride, calcium chloride, and cadmium chloride. Among these salts, sodium chloride and potassium chloride are preferred over others.

Also, chlorine ion may be supplied by a brightening agent added to the developer.

Substances which can be used to supply bromine ion include sodium bromide, potassium bromide, ammonium bromide, lithium bromide, calcium bromide, magnesium bromide, manganese bromide, nickel bromide, cadmium bromide, cerium bromide and thallium bromide. Among these salts, potassium bromide and sodium bromide are preferred over others.

In cases where the supply of chlorine and bromine ions is provided by elution from light-sensitive materials during development processing, the source of both ions may be silver halide emulsions or others.

The color developer used in the present invention is preferably adjusted to pH 9 to 12, particularly pH 9 to 11.0. To the color developer can be added other known developer components.

In order to retain the pH of the color developer in the above-described range, it is desired that various pH buffers should be used. Suitable examples of pH buffers which can be used include carbonates, phosphates, borates, tetraborates, hydroxybenzoates, glycine salts, N,N-dimethylglycine salts, leucine salts, norleucine salts, guanidine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, and so on. Among these salts, carbonates, phosphates, tetraborates and hydroxybenzoates are particularly preferred over others because they are excellent in solubility and buffer capacity in high pH ranges beyond 9.0, do not have any adverse effect on photographic properties when added to the color developer, and are inexpensive.

Specific examples of these buffers include sodium carbonate, potassium carbonate, sodium hydrogen carbonate, potassium hydrogen carbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), and so on. However, this invention should not be construed as being limited to these compounds.

It is desirable that the foregoing buffers be added to the color developer in a concentration of at least 0.1 mol/l, particularly from 0.1 to 0.4 mol/l.

In addition, various kinds of chelating agents can be used in the color developer as a suspending agent for calcium and magnesium ions, or for the purpose of heightening the stability of the color developer. For instance, nitrilotriacetic acid, diethylenetriaminepentaacetic acid, ethylenediaminetetraacetic acid, N,N,N,-trimethylenephosphonic acid, ethylenediamine-N,N,N',N'-tetramethylenesulfonic acid, transcyclohexanediaminetetraacetic acid, 1,2-diaminopropanetetraacetic acid, glycol-ether-diaminetetraacetic acid, ethylenediamine-o-hydroxyphenylacetic acid, 2-phosphonobutane-1,2,4-tricarboxylic acid, 1-hydroxyethylidene- 1,1-diphosphonic acid, N,N'-bis(2-hydroxybenzyl)ethylenediamine-N,N'-diacetic acid, and so on can be used.

The chelating agents cited above may be used in a mixture of two or more thereof, if desired.

Those chelating agents are added in an amount sufficient to block metal ions in the color developer. For example, the addition thereof in an amount of from about 0.1 to about 10 g per liter of the color developer will suffice for blocking metal ions.

To the color developer, any development accelerator can be added, if needed.

Specifically, thioether compounds as disclosed, e.g., in JP-B-37-16088, JP-B-37-5987, JP-B-38-7826, JP-B-44-12380, JP-B-45-9019 and U.S. Pat. No. 3,813,247, p-phenylenediamine compounds disclosed in JP-A-52-49829 and JP-A-50-15554, quaternary ammonium salts disclosed, e.g., in JP-A-50-137726, JP-B-44-30074, JP-A-56-156826 and JP-A-52-43429, amine compounds disclosed, e.g., in U.S. Pat. No. 2,494,903, 3,128,182, 4,230,796 and 3,253,919, JP-B-41-11431, U.S. Pat. No. 2,482,546, 2,596,926 and 3,582,346, polyalkylene oxides disclosed, e.g., in JP-B-37-16088, JP-B-42-25201, U.S. Pat. No. 3,128,183, JP-B-41-11431, JP-B-42-23883 and U.S. Pat. No. 3,532,501, 1-phenyl-3-pyrazolidones, imidazoles and so on can be added as development accelerators, if needed.

Any antifoggant can be added in this invention if needed. Specific examples of an antifoggant which can be used include alkali metal halides, such as sodium chloride, potassium bromide and potassium iodide, and organic antifoggants. As for the organic antifoggants, nitrogen-containing heterocyclic compounds, with specific examples including benzotriazole, 6-nitrobenzimidazole, 5-nitro-isoindazole, 5-methylbenzotriazole, 5-nitrobenzotriazole, 5-chlorobenzotriazole, 2-thiazolylbenzimidazole, 2-thiazolyl-methylbenzimidazole, indazole, hydroxyazaindolidine and adenine, are typical examples.

It is desirable that the color developers applicable to the present invention contain a brightening agent. As a brightening agent, 4,4'-diamino-2,2'-disulfostilbene compounds are used to advantage. These compounds are added in an amount of from 0 to 5 g, preferably from 0.1 to 4 g, per liter of the color developer.

Further, various kinds of surfactants, such as alkylsulfonic acids, arylsulfonic acids, aliphatic carboxylic acids and aromatic carboxylic acids, may be added, if desired.

The processing temperature of the color developers applicable to this invention ranges from 20° to 50° C. preferably from 30° to 40° C. The processing time thereof is within the range of 10 sec. to 3 min., preferably 15 sec. to 2 min., and particularly preferably 15 sec. to 60 sec. In the present invention, color development is carried out continuously as a developing tank is replenished with a replenisher for color development. As for the amount of the replenisher used, it is necessary to control that amount to at most 120 ml per $m^2$ of the light-sensitive material processed. More specifically, the amount replenished is preferably at most 100 ml, more preferably at most 80 ml, and most preferably in the range of 30 to 70 ml, per $m^2$ of the light-sensitive material processed.

In a system which reuses the developer overflowing the developing tank after a so-called regenerating solution is added thereto, the amount of the regenerating solution added per 1 $m^2$ of the light-sensitive material processed corresponds to the foregoing amount of the replenisher used.

A desilvering process applicable to the present invention is described below. In general, the desilvering process may-consist of any step or steps, e.g., the combination of bleach and fixation steps, that of fixation and blix steps, that of bleach and blix steps, a blix step alone, or so on.

The bleaching, bleach-fix and fixing baths which are applicable to the present invention are described below.

Any bleaching agent can be used in the bleaching or bleach-fix bath. In particular, complex salts of Fe(III) and organic acids (e.g., aminopolycarboxylic acids such as ethylenediaminetetraacetic acid, diethylenetriaminepentaacetic acid, etc., aminopolyphosphonic acids, phosphonocarboxylic acids, organic phosphonic acids, and other organic acids such as citric acid, tartaric acid, malic acid, etc.); persulfates; hydrogen peroxide; and so on can be preferably used. Among these bleaching agents, organic complex salts of Fe(III) are particularly favored from the viewpoints of rapid processing and preventing of environmental pollution. Examples of aminopolycarboxylic acids, aminopolyphosphonic acids, organic phosphonic acids and salts thereof, which are useful for forming organic complex salts of Fe(III) include ethylenediaminetetraacetic acid, diethylenetriaminepentaacetic acid, 1,3-diaminopropanetetraacetic acid, prolylenediaminetetraacetic acid, nitrilotriacetic acid, cyclohexanediaminetetraacetic acid, methyliminodiacetic acid, iminodiacetic acid, glycoletherdiaminetetraacetic acid, and so on. These acids may assume any salt form including those of sodium salt, potassium salt, lithium salt and ammonium salt. Of these compounds, Fe(III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred over others because of their high bleaching power. These ferric ion complexes may be used in the form of a complex salt itself, or may be formed in a processing bath by adding thereto both ferric salt, e.g., ferric sulfate, ferric chloride, ferric nitrate, ammonium ferric sulfate, ferric phosphate or the like, and a chelating agent, such as an aminopolycarboxylic acid, an aminopolyphosphonic acid, a phosphonocarboxylic acid, etc. Moreover, such a chelating agent may be used in excess of the need for formation of the ferric ion complex salts. Among the ferric ion complexes, aminopolycarboxylic acid-Fe(III) complex salts are preferred over others, and they are added in an amount of from 0.01 to 1.0 mole, preferably from 0.05 to 0.50 mole, per liter of the processing bath.

In a bleaching bath, a bleach-fix bath and/or a prebath thereof, various compounds can be used as a bleach accelerator. For example, the use of compounds containing a mercapto group or a disulfide linkage, as disclosed in U.S. Pat. No. 3,893,858, German Patent 1,290,812, JP-A-53-95630 and *Research Disclosure,* No. 17129 (July, 1978), thiourea compounds as disclosed in JP-B-45-8506, JP-A-52-20832, JP-A-53-32735 and U.S. Pat. No. 3,706,561, or halides such as iodine ion, bromine ion, and the like are favored with respect to the attainment of excellent bleachability.

In addition, a rehalogenating agent, such as bromides (e.g., potassium bromide, sodium bromide, ammonium bromide), chlorides (e.g., potassium chloride, sodium chloride, ammonium chloride), iodides (e.g., ammonium iodide) or the like, can be contained in the bleaching or bleach-fix bath applicable to this invention. Moreover, a pH buffering combination constituted by one or more of an inorganic or organic acid and an alkali metal or ammonium salt thereof, including borax, sodium metaborate, acetic acid, sodium acetate, sodium carbonate, potassium carbonate, phosphorous acid, phosphoric acid, sodium phosphate, citric acid, sodium citrate, tartaric acid and so on; a corrosion inhibitor such as ammonium nitrate, guanidine, etc.; and so on can be added, if needed.

The fixing agent used in the bleach-fix or fixing bath includes the known agents, namely watersoluble silver halide solvents such as thiosulfates (e.g., sodium thiosulfate, ammonium thiosulfate), thiocyanates (e.g., sodium thiocyanate, ammonium thiocyanate), thioether compounds (e.g., ethylenebisthioglycolic acid, 3,6-dithia-1,8-octanediol). These compounds can be used alone or as a mixture of two or more thereof. Also, a special bleach-fix bath comprising a combination of the fixing agent disclosed in JP-A-55-155354 and a large quantity of halide such as potassium iodide can be employed. In the present invention, the use of a thiosulfate, especially ammonium thiosulfate, as a fixing agent is preferred. The amount of the fixing agent used per liter of the processing bath ranges preferably from 0.3 to 2 moles, and more preferably from 0.5 to 1.0 mole. The suitable pH range of the bleach-fix bath or that of the fixing bath is from 3 to 10, particularly from 5 to 9.

In the bleach-fix bath, various kinds of brightening agents, defoaming agents or surfactants, polyvinyl pyrrolidone and organic solvents such as methanol can also be included.

It is desired that the bleach-fix bath and the fixing bath contain, as preservatives, sulfite ion-releasing compounds such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite). These compounds are added in a concentration of from about 0.02 to about 0.05 mol/l, preferably from 0.04 to 0.40 mol/l, based on the sulfite ion.

As for the preservatives, sulfites are generally used, but ascorbic acid, carbonyl-bisulfite adducts, carbonyl compounds and so on may be also used.

Further, buffers, brightening agents, chelating agents, defoaming agents, antimolds and so on may be added, if desired.

After the desilvering process which comprises fixing, bleach-fix or like steps, washing and/or stabilization processing is, in general, carried out.

The volume of washing water required in the washing process can be determined variously depending on the characteristics of the light-sensitive materials to be processed (e.g., on what kinds of couplers are incorporated therein), the end-use purposes of the light-sensitive materials to be processed, the temperature of the washing water, the number of washing tanks (the number of stages), the path of the replenishing water (e.g., whether a current of water flows in the counter direction or not), and other various conditions. Of these conditions, the relation between the number of washing tanks and the volume of washing water in the multistage counter current process can be determined according to the methods described in *Journal of the Society of Motion Picture and Television Engineers,* volume 64, pages 248 to 253 (May 1955). In general, a desirable number of stages in the multistage counter current process is from 2 to 6, especially from 2 to 4.

According to the multistage counter current process, the volume of washing water can be sharply decreased. Specifically, the volume thereof can be reduced to 0.5 liter or less per $m^2$ of light-sensitive material. Under these circumstances, the effects of this invention are produced remarkably. However, the process has a disadvantage in that bacteria which have propagated themselves in the tanks because of an increase in the staying time of the water in the tanks produce a suspended matter, and the resulting suspending matter adheres to light-sensitive materials processed therein. As a measure for solving this problem, the method of lowering calcium and magnesium ion concentrations, as disclosed in JP-A-62-288838, can be employed to great advantage. Further bactericides such as isothiazolone compounds and thiabendazole compounds disclosed in JP-A-57-8542; chlorine-containing germicides such as sodium salt of chlorinated isocyanuric acid disclosed in JP-A-61-120145; and germicides such as benzotriazoles disclosed in JP-A-61-267761, copper ion and so on, as described in Hiroshi Horiguchi, *Bohkin Bohbai no Kagaku* (which means "Antibacterial and Moldproof Chemistry"), Sankyo Shuppan (1986); *Biseibutsu no Mekkin Sakkin Bohbai Gijutsu* (which means "Arts of Sterilizing and Pasteurizing Microbes, and Proofing Against Molds"), compiled by Eisei Gijutsukai, published by Kogyo Gijutsu Kai in 1982; and *Bohkin-Bohbazai Jiten* (which means "Thesaurus of Antibacteria and Antimolds"), compiled by Nippon Bohkin Bohbai Gakkai.

In the washing water, surfactants as draining agents and chelating agents represented by EDTA as water softeners can additionally be used.

Subsequently to the above-described washing step, or directly after the desilvering process without undergoing any washing step, light-sensitive materials can be processed with a stabilizer. To the stabilizer, compounds having an image stabilizing function, e.g., aldehyde series compounds represented by formaldehyde, buffers for adjusting the processed films to a pH value suitable for stabilization of dyes, and ammonium compounds, are added. Further, the foregoing various germicides and antimolds can be added thereto in order to prevent bacteria from propagating themselves in the stabilizer and to keep the processed light-sensitive materials from getting moldy.

Furthermore, a surfactant, a brightening agent and a hardener can be added, too. In subjecting the light-sensitive material of .the present invention directly to a stabilization processing without carrying out any washing step, all known methods disclosed in JP-A-57-8543, JP-A-58-14834, JP-A-60-220435, and so on can be applied.

Moreover, chelating agents such as 1-hydroxyethylidene-1,1-diphosphonic acid, ethylenediaminetetramethylenephosphonic acid and the like, and magnesium and bismuth compounds can be used to advantage in the stabilizing bath.

A so-called rinsing solution can likewise be used as a washing water or a stabilizing solution after the desilvering processing.

A suitable pH for the washing or stabilization step ranges from 4 to 10, more preferably from 5 to 8. The temperature, though can be chosen variously depending on the characteristics and the intended use of the light-sensitive materials to be processed and ranges from 15° C. to 45° C., preferably from 20° C. to 40° C. As for the time, though it can be also arbitrarily chosen, it is more advantageous to finish the washing or stabilization step in a shorter time from the standpoint of saving processing time. A suitable time ranges from 15 seconds to 1 minute and 45 seconds, more preferably from 30 seconds to 1 minute and 30 seconds.

From the standpoints of running cost, reduction of wastes, handling facility, etc., it is more desirable that the washing or stabilization bath be replenished in a small amount. A desirable replenishing amount ranges from 0.5 to 50 times, preferably from 3 to 40 times, the quantity of the processing solution brought thereinto from the prebath thereof per unit area of the light-sensitive material. In other words, it is below 1 liter, preferably below 500 ml, per $m^2$ of light-sensitive material. The replenishment may be carried out either continuously or intermittently.

A solution used in the washing and/or stabilization step can further be used in the prior step. For instance, the overflow of washing water, which is reduced in quantity by adopting the multistage counter current process, is made to flow into a bleach-fix bath arranged as the prebath, and the bleach-fix bath is replenished with a concentrated solution, resulting in a reduction in the quantity of the waste solution.

The present invention will now be described by way of the following example.

EXAMPLE 1

The surface of a paper support laminated with polyethylene on both sides was subjected to a corona discharge operation, provided with a gelatin undercoat containing sodium dodecylbenzenesulfonate, and further coated with various photographic constituent layers to prepare a multilayer color photographic paper having the following layer structure (Sample No. 101). Coating compositions used were prepared in the manner described below.

Preparation of Coating Solution for First Layer:

A yellow coupler (ExY) in the amount of 153.0 g, 15.0 g of a color image stabilizer (Cpd-1), 7.5 g of a color image stabilizer (Cpd-2) and 16.0 g of a color image stabilizer (Cpd-3) were dissolved in a mixed solvent consisting of 180.0 ml of ethyl acetate, 25 g of a solvent (Solv-1) and 25 g of a solvent (Solv-2), and then dispersed in an emulsified condition into 1,000 ml of a 10% aqueous gelatin solution containing 60 ml of a 10% solution of sodium dodecylbenzenesulfonate and 10 g of citric acid to prepare emulsified Dispersion A. On the other hand, two kinds of silver chlorobromide emulsions [both of which had a cubic crystal form; one of which had an average grain size of 0.88 μm and a variation coefficient of 0.08 with respect to the grain size distribution (large-sized Emulsion B1), and the other of which had an average grain size of 0.70 μm and a variation coefficient of 0.10 with respect to the grain size distribution (small-sized Emulsion B2); both of which contained 0.3 mol % of silver bromide in which the bromide was localized in part of the grain surface] were prepared. These Emulsions B1 and B2 were mixed in a ratio of 6:4 by mole on a silver basis to obtain a silver chlorobromide Emulsion B.

The silver chlorobromide Emulsion B was mixed homogeneously with the foregoing emulsified Dispersion A, and thereto were added other ingredients described below so as to obtain the coating solution for the first layer having the following composition.

Coating solutions for the second to seventh layers were prepared respectively in the same manner as that for the first layer. In each layer, sodium salt of 1-oxy-3,5-dichloro-s-triazine was used as gelatin hardener.

In addition, Cpd-15 and Cpd-16 were added to all layers so that their coverages was 25.0 mg/m$^2$ and 50.0 mg/m$^2$, respectively.

Spectral sensitizing dyes illustrated below were added to the silver chlorobromide emulsions for each light-sensitive emulsion layer.

Blue-sensitive Emulsion Layer

Sensitizing Dye A

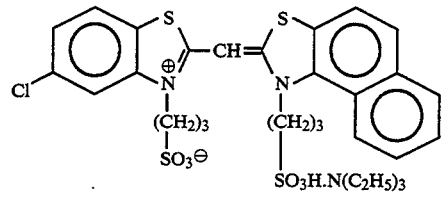

and

Sensitizing Dye B

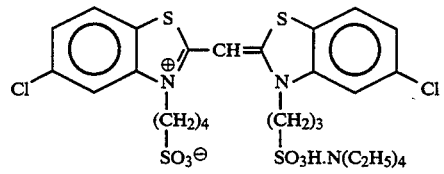

(In blue-sensitive emulsion layer Sensitizing Dyes A and B illustrated above were added to the large-sized emulsion in the same amount of $2.0\times10^{-4}$ mole per mole silver, and to the small-sized emulsion in the same amount of $2.5\times10^{-4}$ mole per mole of silver.)

Green-sensitive Emulsion Layer

Sensitizing Dye C

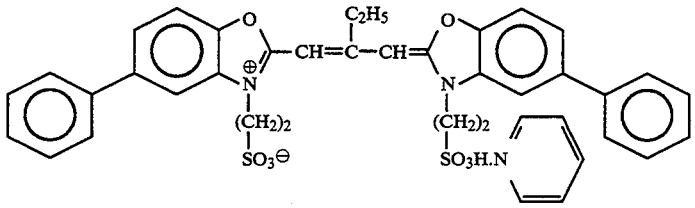

(In green-sensitive emulsion layer Sensitizing Dye C illustrated above was added to the large-sized emulsion in the amount of $4.0\times10^{-4}$ mole per mole silver, and to the small-sized emulsion in the amount of $5.6\times10^{-4}$ mole per mole of silver.)

Sensitizing Dye D

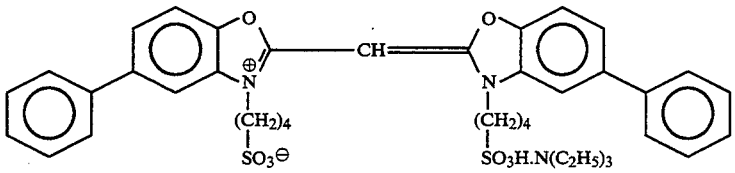

(Sensitizing Dye D illustrated above was added to the large-sized emulsion in the amount of $7.0\times10^{-5}$ mole per mole silver, and to the small-sized emulsion in the amount of $1.0\times10^{-5}$ mole per mole of silver.)

Red-sensitive Emulsion Layer

Sensitizing Dye E

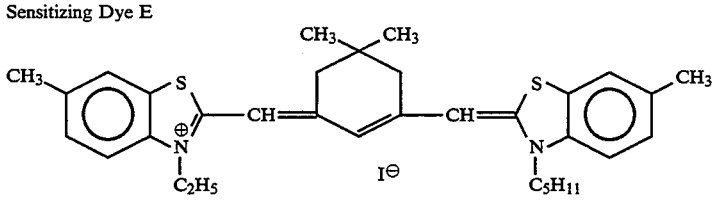

In red-sensitive emulsion layer, Sensitizing Dye E was added to the large-sized emulsion in the amount of $0.9\times10^{-4}$ mole per mole silver, and to the small-sized emulsion in the amount of $1.1\times10^{-4}$ mole per mole silver.

Further the following compound was added in the amount of $2.6\times10^{-3}$ mole per mole of silver halide in the red-sensitive emulsion layer:

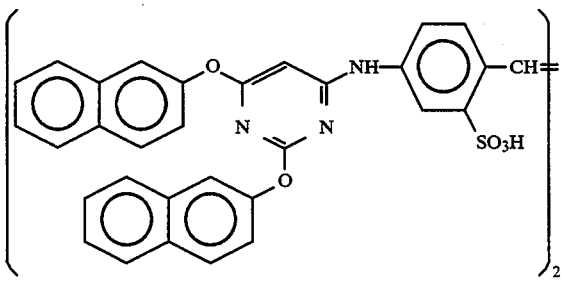

-continued

Moreover, 1-(5-methylureidophenyl)-5-mercaptotetrazole was added to the blue-sensitive emulsion layer, the green-sensitive emulsion layer and the red-sensitive emulsion layer in amounts of $3.4\times10^{-4}$ mole, $9.7\times10^{-4}$ mole and $5.5\times10^{-4}$ mole, respectively, per mole of silver halide.

Furthermore, 4-hydroxy-6-methyl-1,3,3a,7-tetraazaindene was added to the blue-sensitive emulsion layer and the green-sensitive emulsion layer in amounts of $1\times10^{-4}$ mole and $2\times10^{-4}$ mole, respectively, per mole of silver halide.

In addition, the dyes illustrated below (their respective coverages are designated in parentheses) were added to each emulsion layer in order to inhibit an irradiation phenomenon from occurring.

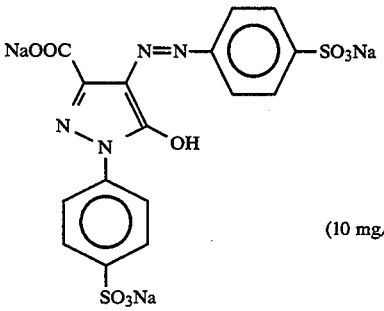

(10 mg/m²)

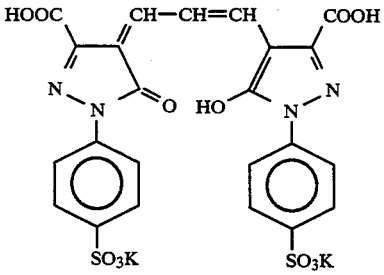

(10 mg/m²)

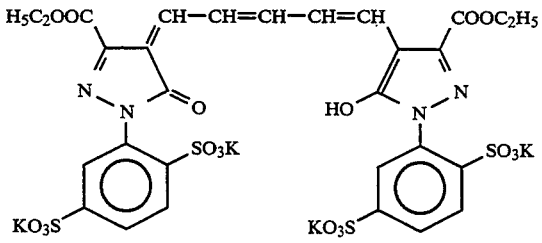

(40 mg/m²)

and

-continued

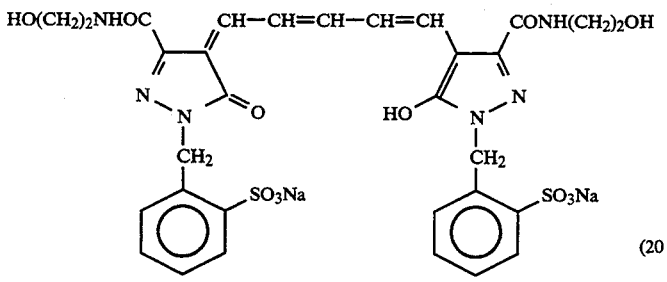

(20 mg/m$^2$)

[Layer Structure]

The composition of each constituent layer is described below. Each figure on the right side designates the coverage (g/m$^2$) of the ingredient corresponding thereto. As for the silver halide emulsion, the figure represents the coverage based on silver.

Support:

Polyethylene-laminated paper which contained white pigment ($TiO_2$) and a bluish dye (ultramarine) in the polyethylene laminate on the side of the first layer

| | |
|---|---|
| First layer (blue-sensitive emulsion layer): | |
| The foregoing silver chlorobromide Emulsion B | 0.27 |
| Gelatin | 1.36 |
| Yellow coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| Second layer (color stain inhibiting layer): | |
| Gelatin | 1.00 |
| Color stain inhibitor (Cpd-4) | 0.10 |
| Color image stabilizer (Cpd-5) | 0.05 |
| Solvent (Solv-2) | 0.30 |
| Solvent (Solv-3) | 0.30 |
| Third layer (green-sensitive emulsion layer): | |
| Silver chlorobromide emulsion (having a cubic crystal form and being a 6:4 mixture of a large-sized Emulsion G1 having an average grain size of 0.55 μm and a variation coefficient of 0.10 with respect to grain size distribution with a small-sized Emulsion G2 having an average grain size of 0.39 μm and a variation coefficient of 0.08 with respect to grain size distribution, which each contained 0.8 mol % of AgBr localized in part of the grain surface) | 0.13 |
| Gelatin | 1.45 |
| Magenta coupler (ExM) | 0.16 |
| Color image stabilizer (Cpd-6) | 0.15 |
| Color image stabilizer (Cpd-2) | 0.03 |
| Color image stabilizer (Cpd-7) | 0.01 |
| Color image stabilizer (Cpd-8) | 0.01 |
| Color image stabilizer (Cpd-9) | 0.08 |

-continued

| | |
|---|---|
| Solvent (Solv-3) | 0.50 |
| Solvent (Solv-4) | 0.15 |
| Solvent (Solv-5) | 0.15 |
| Fourth layer (color stain inhibiting layer): | |
| Gelatin | 1.00 |
| Color stain inhibitor (Cpd-4) | 0.10 |
| Color image stabilizer (Cpd-5) | 0.05 |
| Solvent (Solv-2) | 0.30 |
| Solvent (Solv-3) | 0.30 |
| Fifth layer (red-sensitive emulsion layer): | |
| Silver chlorobromide emulsion (having a cubic crystal form and being a 7:3 mixture of a large-sized Emulsion R1 having an average grain size of 0.58 μm and a variation coefficient of 0.09 with respect to grain size distribution and a small-sized Emulsion R2 having an average grain size of 0.45 μm and a variation coefficient of 0.11 with respect to grain size distribution, which each contained 0.6 mol % of AgBr localized in part of the grain surface) | 0.20 |
| Gelatin | 0.85 |
| Cyan coupler (ExC) | 0.33 |
| Ultraviolet absorbent (UV-2) | 0.18 |
| Color image stabilizer (Cpd-1) | 0.40 |
| Color image stabilizer (Cpd-10) | 0.15 |
| Color image stabilizer (Cpd-11) | 0.15 |
| Color image stabilizer (Cpd-12) | 0.01 |
| Color image stabilizer (Cpd-9) | 0.01 |
| Color image stabilizer (Cpd-8) | 0.01 |
| Solvent (Solv-6) | 0.22 |
| Solvent (Solv-1) | 0.01 |
| Sixth layer (ultraviolet absorbing layer): | |
| Gelatin | 0.57 |
| Ultraviolet absorbent (UV-1) | 0.40 |
| Color image stabilizer (Cpd-13) | 0.15 |
| Color image stabilizer (Cpd-6) | 0.02 |
| Seventh layer (protective layer): | |
| Gelatin | 1.13 |
| Acryl-modified polyvinyl alcohol (modification degree: 17%) | 0.15 |
| Liquid paraffin | 0.03 |
| Color image stabilizer (Cpd-6) | 0.01 |

The structural formulae of the compounds used herein are illustrated below:

(ExY) Yellow coupler

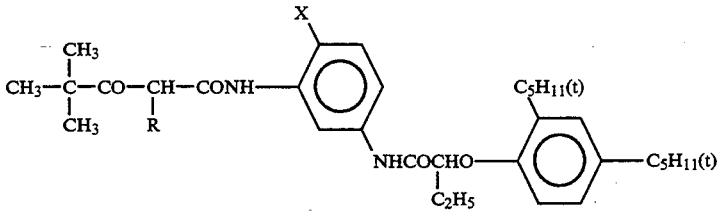

1:1 (by mole) mixture of that containing

-continued
R = 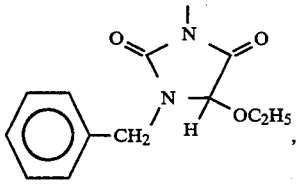 , X = Cl
with that containing
R = 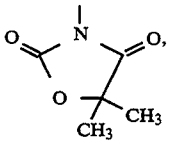 , X = $OCH_3$
(ExM) Magenta coupler
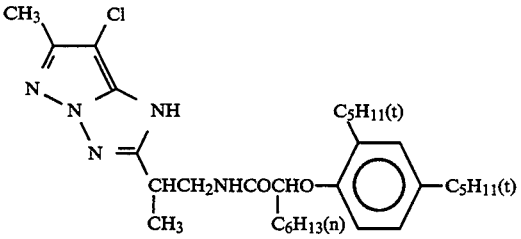
(ExC) Cyan coupler
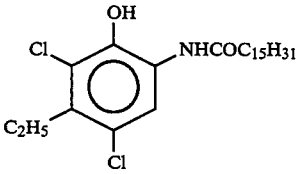
(Cpd-1) Color image stabilizer
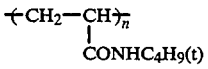
(Average molecular weight: 60,000)
(Cpd-2) Color image stabilizer
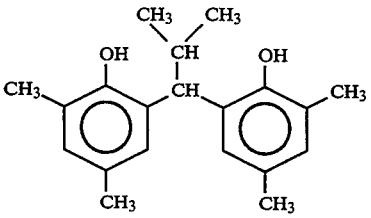
(Cpd-3) Color image stabilizer
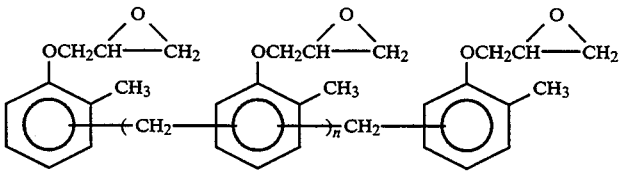
n = 7–8 (on average)
(Cpd-4) Color stain inhibitor -continued
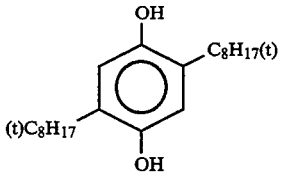
(Cpd-5) Color image stabilizer
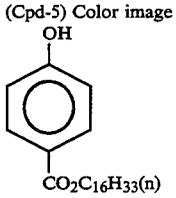
(Cpd-6) Color image stabilizer
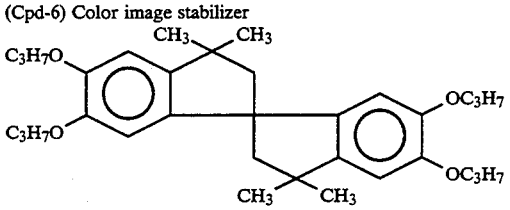
(Cpd-7) Color image stabilizer
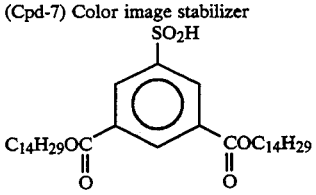
(Cpd-8) Color image stabilizer
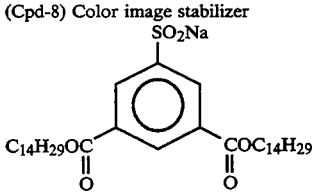
(Cpd-9) Color image stabilizer
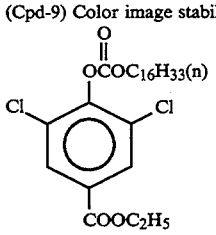
(Cpd-10) Color image stabilizer
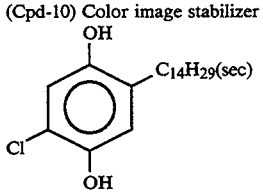
(Cpd-11) Color image stabilizer
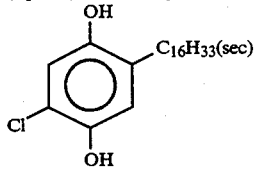
(Cpd-12) Color image stabilizer -continued
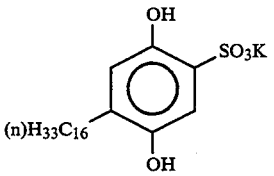
(Cpd-13) Color image stabilizer
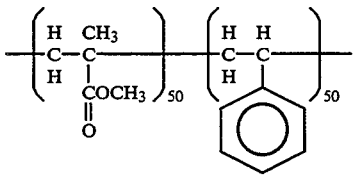
average molecular weight: about $6.0 \times 10^4$
(Cpd-14) Color image stabilizer
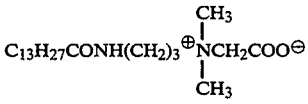
(Cpd-15) Antiseptic
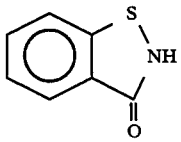
(Cpd-16) Antiseptic
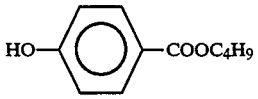
(UV-1) Ultraviolet absorbent
10:5:1:5 (by weight) Mixture of (1), (2), (3) and (4):
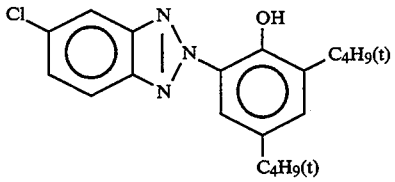
(1)
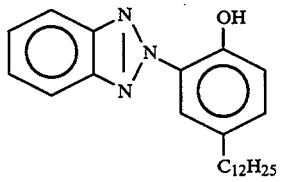
(2)
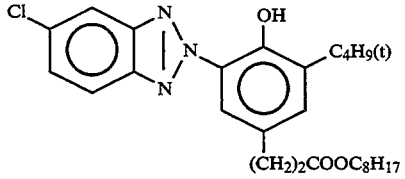
(3)

-continued
(4)
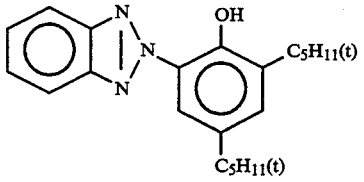
(UV-2) Ultraviolet absorbent
1:2:2 (by weight) Mixture of (1), (2) and (3):
(1)
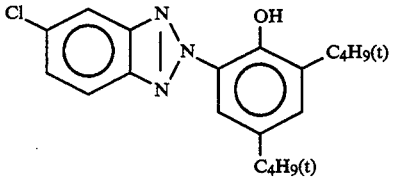
(2)
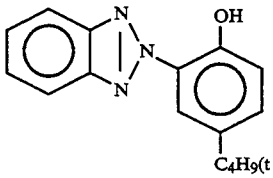
(3)
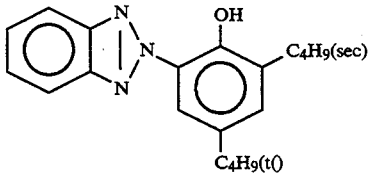
(Solv-1) Solvent
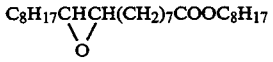
(Solv-2) Solvent
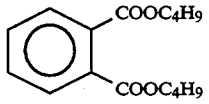
(Solv-3) Solvent
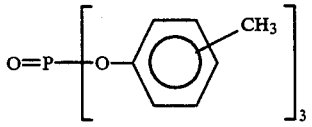
(Solv-4) Solvent
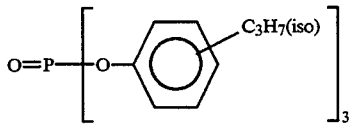
(Solv-5) Solvent
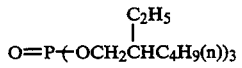
(Solv-6) Solvent -continued

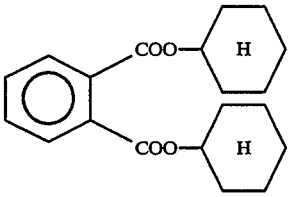

ExT (fro comparison)

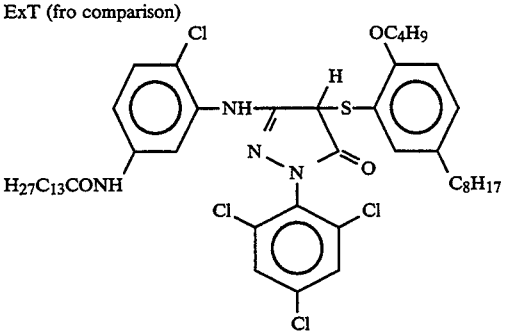

Sample Nos. 102 to 113 were prepared in the same manner as Sample No. 101, except that compositions of the first, third, fourth and sixth layers were changed as shown in Table 2.

Additionally, the quantity of gelatin in each layer was also changed so that the ratio of gelatin to the oil-soluble ingredients therein might remain constant in order to maintain the film strength of the finished light-sensitive material constant.

TABLE 2

| Sample No. | Gelatin in 1st layer | Coupler in 3rd layer | UV-1 in 4th layer | Gelatin in 4th layer | UV-1 in 6th layer | Gelatin in 6th layer | Total gelatin coverage | Note |
|---|---|---|---|---|---|---|---|---|
| 102 | 1.36 | ExM | 0.2 | 1.44 | 0.4 | 0.57 | 7.80 | Comparison |
| 103 | 1.36 | ExM | 0.4 | 1.89 | 0.4 | 0.57 | 8.25 | Comparison |
| 104 | 1.36 | ExM | 0.8 | 2.78 | 0.4 | 0.57 | 9.14 | Comparison |
| 105 | 1.36 | ExT | 0 | 1.00 | 0.4 | 0.57 | 7.36 | Comparison |
| 106 | 1.36 | ExT | 0.2 | 1.44 | 0.4 | 0.57 | 7.80 | Comparison |
| 107 | 1.36 | ExT | 0.4 | 1.89 | 0.4 | 0.57 | 8.25 | Comparison |
| 108 | 1.36 | ExT | 0.8 | 2.78 | 0.4 | 0.57 | 9.14 | Comparison |
| 109 | 1.16 | ExT | 0.8 | 2.78 | 0.4 | 0.57 | 8.94 | Comparison |
| 110 | 1.36 | ExM | 0.2 | 1.44 | 0.2 | 0.37 | 7.60 | Comparison |
| 111 | 1.36 | ExM | 0.4 | 1.89 | 0 | 0.17 | 7.85 | Comparison |
| 112 | 1.86 | ExM | 0 | 1.44 | 0.4 | 0.57 | 7.86 | Invention |
| 113 | 1.16 | ExM | 0 | 1.44 | 0.4 | 0.57 | 7.16 | Invention |

First Sample No. 101 was subjected to a gray exposure to bring about development of about 30% of the coated silver by means of a sensitometer (Model FWH, produced by Fuji Photo Film Co., Ltd., equipped with a light source having a color temperature of 3,200° K.).

Continuous processing was performed using the thus exposed sample and a paper processor loaded with processing solutions having the respective compositions described below and working in accordance with the following processing steps until the development-processing conditions were in running equilibrium.

| Processing Step | Temperature | Time | Amount* replenished | Tank Volume |
|---|---|---|---|---|
| Color development | 35° C. | 45 sec. | 161 ml | 17 l |
| Bleach-fix | 30–35° C. | 45 sec. | 215 ml | 17 l |
| Rinsing | 30° C. | 90 sec. | 350 ml | 10 l |
| Drying | 70–80° C. | 60 sec. | | |

*per $m^2$ of photographic material

The composition of each processing solution is described below.

Color Developer:

| | Tank Solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-Methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl)-hydroxylamine | 4.0 g | 5.0 g |
| Brightening agent (WHITEX 4B, produced by Sumitomo Chemical Co., Ltd.) | 1.0 g | 2.0 g |
| Water to make | 1,000 ml | 1,000 ml |
| pH (25° C.) adjusted to | 10.05 | 10.45 |

Bleach-Fix Bath (Tank solution = Replenisher):

| | |
|---|---|
| Water | 400 ml |
| Ammonium thiosulfate (700 g/l) | 100 ml |
| Sodium sulfite | 17 g |
| Ammonium ethylenediaminetetra-acetatoferrate(III) | 55 g |
| Disodium ethylenediaminetetraacetate | 5 g |
| Ammonium bromide | 40 g |
| Water to make | 1,000 ml |

-continued

| | |
|---|---|
| pH (25° C.) adjusted to | 6.0 |

Rinsing Bath (Tank solution=Replenisher):

Ion exchange water (in which calcium and magnesium ion concentrations were each below 3 ppm).

Then, Sample Nos. 101 to 113 were each exposed through a gradation wedge by means of the same sensitometer as described above (Model FWH, products of Fuji Photo Film, Co., Ltd.) so that they were nearly gray in the area having a developed color density of 1.0, followed by color photographic processing in accordance with the foregoing processing steps.

| Criterion of Evaluation | Grade |
|---|---|
| Bluish unevenness is not observed at all | 5 |
| Bluish unevenness is occasionally observed, but matters little | 4 |
| Bluish unevenness is faintly observed, but inoffensive | 3 |
| Bluish unevenness.is observed | 2 |
| Bluish unevenness is observed continuously and distinctly | 1 |

It was desirable for practical use that the grade be at least 4.

The results obtained are shown in Table 3.

TABLE 3

| Sample No. | ΔM (%) | ΔC (%) | Bluish Unevenness in the Edge Part Processing A | Processing B | Processing C | Note |
|---|---|---|---|---|---|---|
| 101 | 26.6 | 26.6 | 5 | 5 | 4 | Invention |
| 102 | 26.0 | 26.6 | 5 | 3 | 2 | Comparison |
| 103 | 25.0 | 26.6 | 4 | 1 | 1 | Comparison |
| 104 | 23.9 | 26.0 | 3 | 1 | 1 | Comparison |
| 105 | 36.0 | 27.1 | 5 | 5 | 4 | Comparison |
| 106 | 35.3 | 27.0 | 5 | 3 | 2 | Comparison |
| 107 | 33.0 | 27.0 | 4 | 1 | 1 | Comparison |
| 108 | 32.1 | 26.5 | 3 | 1 | 1 | Comparison |
| 109 | 32.3 | 26.3 | 4 | 2 | 2 | Comparison |
| 110 | 26.7 | 38.7 | 5 | 5 | 4 | Comparison |
| 111 | 26.8 | 50.8 | 4 | 4 | 3 | Comparison |
| 112 | 26.5 | 26.1 | 5 | 5 | 4 | Invention |
| 113 | 26.6 | 26.6 | 5 | 5 | 5 | Invention |

In order to evaluate light fastness of the thus processed samples, the samples previously examined for optical density were fixed on a glass window facing south over a 3-month period, and their optical densities were measured again. Thereby, the lowering rates of the cyan and magenta densities in the areas having an initial density of 1.5 were determined. The results obtained are shown in Table 3.

Further, two other color developers in a running equilibrium state were prepared carrying out continuous processing in the same way as described above, except that the amounts of the replenisher added in the color development step were changed to 120 ml/m$^2$ and 80 ml/m$^2$, respectively, from 161 ml/m$^2$. The thus obtained color developers corresponding to the amounts replenished, 161 ml/m$^2$, 120 ml/m$^2$ and 80 ml/m$^2$, were named Color Developers A, B and C, respectively.

Since Color Developers B and C suffered a drop in sensitivity because of reduced replenishment, the development condition was controlled by raising their respective development temperatures so that photographic properties obtained with these three kinds of color developers would be nearly equivalent, as is customary in the art.

The resulting temperatures of Color Developers B and C were 37° C. and 40.5° C., respectively, while that of Color Developer A was 35° C.

Each of the samples was exposed by means of a roll type color printer so that the area having a magenta color density of about 1.5 would look nearly gray, and then processed in separate Processings A, B and C using an automatic developing machine which was loaded by turns with the Color Developers A, B and C controlled to the above-described temperatures, respectively. The thus formed images were examined for bluish unevenness in the edge part thereof. An evaluation was made by grading them by the extent of bluish unevenness in accordance with the criterion described below:

It can be seen from Table 3 that Sample Nos. 105 to 109, in which a magenta coupler other than those of the present invention was used, suffered serious photodiscoloration with respect to the developed magenta color. Addition of an ultraviolet absorbent to the fourth layer reduced the extent of photodiscoloration, but aggravated the bluish unevenness in the edge part. Even when the gelatin coverage was decreased in addition, it was impossible to reduce the extent of bluish unevenness up to a satisfactory level. Sample Nos. 110 and 111, on the other hand, were undesirable because the developed cyan color suffered considerable discoloration. In contrast, the samples of the present invention, Sample Nos. 101, 112 and 113, were satisfactory with respect to all evaluation items. In particular, the Sample 113 whose gelatin coverage was below 7.5 g/m$^2$ in total and below 1.3 g/m$^2$ with respect to the yellow color-forming layer alone was highly satisfactory since it was free from bluish unevenness even when the amount replenished was 80 ml/m$^2$ in the color development step.

In accordance with embodiments of the present invention, there can be obtained color prints whose image quality does not suffer even with rapid processing under a reduced replenishment condition, and which are almost free from unevenness of color formation in the edge part.

While the invention has been described in detail and with reference to specific embodiments thereof, it will be apparent to one skilled in the art that various changes and modifications can be made therein without departing from the spirit and scope thereof.

What is claimed is:

1. A method of producing silver halide color photographic images comprising the step of, color developing a silver halide color photographic material which has a total gelatin coverage of at most 7.5 g/m$^2$ and which comprises a reflecting support and provided thereon three light sensitive silver halide emulsion layers each having a light sensitivity to a different wavelength region, including a light sensitive silver halide emulsion layer which has a gelatin coverage of below 1.3 g/m$^2$ and containing a yellow dye forming coupler, a light sensitive silver halide layer containing a magenta dye forming coupler, and a light sensitive layer containing a cyan dye forming coupler, wherein said photographic material contains at least one magenta coupler which is a pyrazolotriazole coupler in which the 2-, 3- or 6-position of the pyrazolotriazole ring is substituted by a branched alkyl group in the magenta coupler-containing silver halide emulsion layer, and the cyan coupler-containing silver halide emulsion layer is situated in a position more distant from the support than the magenta coupler-containing silver halide emulsion layer, and wherein (a) a hydrophilic light-insensitive layer containing a compound represented by the following general formula (I) in the substantial absence of any ultraviolet absorbent is provided at a position underneath the cyan coupler-containing silver halide emulsion layer, (b) a hydrophilic light-insensitive layer containing an ultraviolet absorbent in the substantial absence of any compound represented by the following general formula (I) is provided above the cyan coupler-containing silver halide emulsion layer, and (c) silver halide grains contained in every emulsion layer have an average chloride content of at least 90 mol %; and wherein said color development is performed continuously with a color developing solution at a replenishment rate of at most 80 ml of replenisher per m$^2$ of silver halide color photographic material processed thereby;

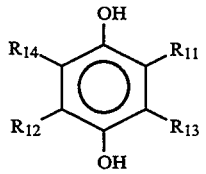

(I)

(wherein $R_{11}$ and $R_{12}$ may be the same or different and each represents a hydrogen atom, an alkyl group, an alkenyl group, an aryl group, an acyl group, a cycloalkyl group, a sulfonic acid group, a halogen atom or a heterocyclic group; $R_{13}$ and $R_{14}$ may be the same or different and each represents a hydrogen atom, a halogen atom, an alkyl group, an aryl group, a cycloalkyl group, an alkoxy group, an aryloxy group, an arylthio group, an acyl group, an alkylacylamino group, an arylacylamino group, an alkyl-carbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group; provided that at least one among $R_{11}$, $R_{12}$, $R_{13}$ and $R_{14}$ is not a hydrogen atom).

2. The color photographic image forming method as claimed in claim 1, wherein the replenishment rate is from 30 to 70 ml per m$^2$ of the light-sensitive material processed.

3. The color photographic image forming method as claimed in claim 1, wherein the amount of the compound according to formula (I) in the hydrophilic light-insensitive layer provided above the cyan coupler-containing silver halide emulsion layer is less than 10 mg per square meter.

4. The color photographic image forming method as claimed in claim 1, wherein the amount of the compound according to formula (I) in the hydrophilic light-insensitive layer provided above the cyan coupler-containing silver halide emulsion layer is 0.

5. The color photographic image forming method as claimed in claim 1, wherein the amount of the ultraviolet absorbent in the hydrophilic light-insensitive layer provided underneath the cyan coupler-containing silver halide emulsion layer is at most 100 mg per square meter.

6. The color photographic image forming method as claimed in claim 1, wherein the amount of the ultraviolet absorbent in the hydrophilic light-insensitive layer provided underneath the cyan coupler-containing silver halide emulsion layer is 0.

7. A method of producing silver halide color photographic images comprising the step of, color developing a silver halide color photographic material which has a total gelatin coverage of at most 7.5 g/m$^2$ and which comprises a reflecting support and provided thereon three light sensitive silver halide emulsion layers each having a light sensitivity to a different wavelength region, including a light sensitive silver halide emulsion layer which has a gelatin coverage of below 1.3 g/m$^2$ and containing a yellow dye forming coupler, a light sensitive silver halide layer containing a magenta dye forming coupler, and a light sensitive layer containing a cyan dye forming coupler, wherein said photographic material contains at least one magenta coupler which is a pyrazolo triazole in which a tertiary alkyl group is substituted at the 6-position or is a pyrazolo triazole in which a tertiary alkyl group is substituted at the 6-position in the magenta coupler-containing silver halide emulsion layer, and the cyan coupler-containing silver halide emulsion layer is situated in a position more distant from the support than the magenta coupler-containing silver halide emulsion layer, and wherein (a) a hydrophilic light-insensitive layer containing a compound represented by the following general formula (I) in the substantial absence of any ultraviolet absorbent is provided at a position underneath the cyan coupler-containing silver halide emulsion layer, (b) a hydrophilic light-insensitive layer containing an ultraviolet absorbent in the substantial absence of any compound represented by the following general formula (I) is provided above the cyan coupler-containing silver halide emulsion layer, and (c) silver halide grains contained in every emulsion layer have an average chloride content of at least 90 mol %; and wherein said color development is performed continuously with a color developing solution at a replenishment rate of at most 80 ml of replenisher per m$^2$ of silver halide color photographic material processed thereby;

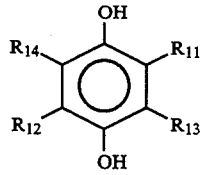

(I)

(wherein $R_{11}$ and $R_{12}$ may be the same or different and each represents a hydrogen atom, an alkyl group, an alkenyl group, an aryl group, an acyl group, a cycloalkyl group, a sulfonic acid group, a halogen atom or a heterocyclic group; $R_{13}$ and $R_{14}$ may be the same or different and each represents a hydrogen atom, a halogen atom, an alkyl group, an aryl group, a cycloalkyl group, an alkoxy group, an aryloxy group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group; provided that at least one among $R_{11}$, $R_{12}$, $R_{13}$ and $R_{14}$ is not a hydrogen atom).

8. The color photographic image forming method as claimed in claim 7, wherein the replenishment rate is from 30 to 70 ml per $m^2$ of the light-sensitive material processed.

9. The color photographic image forming method as claimed in claim 7, wherein the amount of the compound according to formula (I) in the hydrophilic light-insensitive layer provided above the cyan coupler-containing silver halide emulsion layer is less than 10 mg per square meter.

10. The color photographic image forming method as claimed in claim 7, wherein the amount of the compound according to formula (I) in the hydrophilic light-insensitive layer provided above the cyan coupler-containing silver halide emulsion layer is 0.

11. The color photographic image forming method as claimed in claim 7, wherein the amount of the ultraviolet absorbent in the hydrophilic light-insensitive layer provided underneath the cyan coupler-containing silver halide emulsion layer is at most 100 mg per square meter.

12. The color photographic image forming method as claimed in claim 7, wherein the amount of the ultraviolet absorbent in the hydrophilic light-insensitive layer provided underneath the cyan coupler-containing silver halide emulsion layer is 0.

13. A method of producing silver halide color photographic images comprising the step of, color developing a silver halide color photographic material which has a total gelatin coverage of at most 7.5 $g/m^2$ and which comprises a reflecting support and provided thereon three light sensitive silver halide emulsion layers each having a light sensitivity to a different wavelength region, including a light sensitive silver halide emulsion layer which has a gelatin coverage of below 1.3 $g/m^2$ and containing a yellow dye forming coupler, a light sensitive silver halide layer containing a magenta dye forming coupler, and a light sensitive layer containing a cyan dye forming coupler, wherein said photographic material contains at least one magenta coupler which is a pyrazoloazole coupler which contains a sulfonamido group in its molecule in the magenta coupler-containing silver halide emulsion layer, and the cyan coupler-containing silver halide emulsion layer is situated in a position more distant from the support than the magenta coupler-containing silver halide emulsion layer, and wherein (a) a hydrophilic light-insensitive layer containing a compound represented by the following general formula (I) in the substantial absence of any ultraviolet absorbent is provided at a position underneath the cyan coupler-containing silver halide emulsion layer, (b) a hydrophilic light-insensitive layer containing an ultraviolet absorbent in the substantial absence of any compound represented by the following general formula (I) is provided above the cyan coupler-containing silver halide emulsion layer, and (c) silver halide grains contained in every emulsion layer have an average chloride content of at least 90 mol %; and wherein said color development is performed continuously with a color developing solution at a replenishment rate of at most 80 ml of replenisher per $m^2$ of silver halide color photographic material processed thereby;

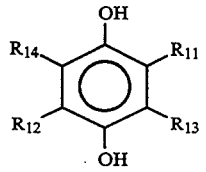

(I)

(wherein $R_{11}$ and $R_{12}$ may be the same or different and each represents a hydrogen atom, an alkyl group, an alkenyl group, an aryl group, an acyl group, a cycloalkyl group, a sulfonic acid group, a halogen atom or a heterocyclic group; $R_{13}$ and $R_{14}$ may be the same or different and each represents a hydrogen atom, a halogen atom, an alkyl group, an aryl group, a cycloalkyl group, an alkoxy group, an aryloxy group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group; provided that at least one among $R_{11}$, $R_{12}$, $R_{13}$ and $R_{14}$ is not a hydrogen atom).

14. The color photographic image forming method as claimed in claim 13, wherein the replenishment rate is from 30 to 70 ml per $m^2$ of the light-sensitive material processed.

15. The color photographic image forming method as claimed in claim 13, wherein the amount of the compound according to formula (I) in the hydrophilic light-insensitive layer provided above the cyan coupler-containing silver halide emulsion layer is less than 10 mg per square meter.

16. The color photographic image forming method as claimed in claim 13, wherein the amount of the compound according to formula (I) in the hydrophilic light-insensitive layer provided above the cyan coupler-containing silver halide emulsion layer is 0.

17. The color photographic image forming method as claimed in claim 13, wherein the amount of the ultraviolet absorbent in the hydrophilic light-insensitive layer provided underneath the cyan coupler-containing silver halide emulsion layer is at most 100 mg per square meter.

18. The color photographic image forming method as claimed in claim 13, wherein the amount of the ultraviolet absorbent in the hydrophilic light-insensitive layer provided underneath the cyan coupler-containing silver halide emulsion layer is 0.

19. A method of producing silver halide color photographic images comprising the step of, color developing a silver halide color photographic material which has a total gelatin coverage of at most 7.5 g/m$^2$ and which comprises a reflecting support and provided thereon three light sensitive silver halide emulsion layers each having a light sensitivity to a different wavelength region, including a light sensitive silver halide emulsion layer which has a gelatin coverage of below 1.3 g/m$^2$ and containing a yellow dye forming coupler, a light sensitive silver halide layer containing a magenta dye forming coupler, and a light sensitive layer containing a cyan dye forming coupler, wherein said photographic material contains at least one magenta coupler which is a pyrazoloazole coupler which contains an alkoxyphenylsulfonamido group as a ballast group in the magenta coupler-containing silver halide emulsion layer, and the cyan coupler-containing silver halide emulsion layer is situated in a position more distant from the support than the magenta coupler-containing silver halide emulsion layer, and wherein (a) a hydrophilic light-insensitive layer containing a compound represented by the following general formula (I) in the substantial absence of any ultraviolet absorbent is provided at a position underneath the cyan coupler-containing silver halide emulsion layer, (b) a hydrophilic light-insensitive layer containing an ultraviolet absorbent in the substantial absence of any compound represented by the following general formula (I) is provided above the cyan coupler-containing silver halide emulsion layer, and (c) silver halide grains contained in every emulsion layer have an average chloride content of at least 90 mol %; and wherein said color development is performed continuously with a color developing solution at a replenishment rate of at most 80 ml of replenisher per m$^2$ of silver halide color photographic material processed thereby;

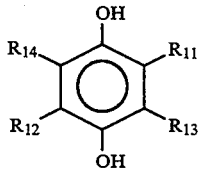

(I)

(wherein $R_{11}$ and $R_{12}$ may be the same or different and each represents a hydrogen atom, an alkyl group, an alkenyl group, an aryl group, an acyl group, a cycloalkyl group, a sulfonic acid group, a halogen atom or a heterocyclic group; $R_{13}$ and $R_{14}$ may be the same or different and each represents a hydrogen atom a halogen atom, an alkyl group, an aryl group, a cycloalkyl group, an alkoxy group, an aryloxy group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group; provided that at least one among $R_{11}$, $R_{12}$, $R_{13}$ and $R_{14}$ is not a hydrogen atom).

20. The color photographic image forming method as claimed in claim 19, wherein the replenishment rate is from 30 to 70 ml per m$^2$ of the light-sensitive material processed.

21. The color photographic image forming method as claimed in claim 19, wherein the amount of the compound according to formula (I) in the hydrophilic light-insensitive layer provided above the cyan coupler-containing silver halide emulsion layer is less than 10 mg per square meter.

22. The color photographic image forming method as claimed in claim 19, wherein the amount of the compound according to formula (I) in the hydrophilic light-insensitive layer provided above the cyan coupler-containing silver halide emulsion layer is 0.

23. The color photographic image forming method as claimed in claim 19, wherein the amount of the ultraviolet absorbent in the hydrophilic light-insensitive layer provided underneath the cyan coupler-containing silver halide emulsion layer is at most 100 mg per square meter.

24. The color photographic image forming method as claimed in claim 19, wherein the amount of the ultraviolet absorbent in the hydrophilic light-insensitive layer provided underneath the cyan coupler-containing silver halide emulsion layer is 0.

25. A method of producing silver halide color photographic images comprising the step of, color developing a silver halide color photographic material which has a total gelatin coverage of at most 7.5 g/m$^2$ and which comprises a reflecting support and provided thereon three light sensitive silver halide emulsion layers each having a light sensitivity to a different wavelength region, including a light sensitive silver halide emulsion layer which has a gelatin coverage of below 1.3 g/m$^2$ and containing a yellow dye forming coupler, a light sensitive silver halide layer containing a magenta dye forming coupler, and a light sensitive layer containing a cyan dye forming coupler, wherein said photographic material contains at least one magenta coupler which is a pyrazolotriazole coupler in which the 6-position is substituted by an alkoxy group or an aryloxy group in the magenta coupler-containing silver halide emulsion layer and the cyan coupler-containing silver halide emulsion layer, is situated in a position more distant from the support than the magenta coupler-containing silver halide emulsion layer, and wherein (a) a hydrophilic light-insensitive layer containing a compound represented by the following general formula (I) in the substantial absence of any ultraviolet absorbent is provided at a position underneath the cyan coupler-containing silver halide emulsion layer, (b) a hydrophilic light-insensitive layer containing an ultraviolet absorbent in the substantial absence of any compound represented by the following general formula (I) is provided above the cyan coupler-containing silver halide emulsion layer, and (c) silver halide grains contained in every emulsion layer have an average chloride content of at least 90 mol %; and wherein said color development is performed continuously with a color developing solution at a replenishment rate of at most 80 ml of replenisher per $m^2$ of silver halide color photographic material processed thereby;

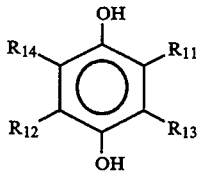

(I)

(wherein $R_{11}$ and $R_{12}$ may be the same or different and each represents a hydrogen atom, an alkyl group, an alkenyl group, an aryl group, an acyl group, a cycloalkyl group, a sulfonic acid group, a halogen atom or a heterocyclic group; $R_{12}$ and $R_{14}$ may be the same or different and each represents a hydrogen atom, a halogen atom, an alkyl group, an aryl group, a cycloalkyl group, an alkoxy group, an aryloxy group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group; provided that at least one among $R_{11}$, $R_{12}$, $R_{13}$ and $R_{14}$ is not a hydrogen atom).

26. The color photographic image forming method as claimed in claim 25, wherein the replenishment rate is from 30 to 70 ml per $m^2$ of the light-sensitive material processed.

27. The color photographic image forming method as claimed in claim 25, wherein the amount of the compound according to formula (I) in the hydrophilic light-insensitive layer provided above the cyan coupler-containing silver halide emulsion layer is less than 10 mg per square meter.

28. The color photographic image forming method as claimed in claim 25, wherein the amount of the compound according to formula (I) in the hydrophilic light-insensitive layer provided above the cyan coupler-containing silver halide emulsion layer is 0.

29. The color photographic image forming method as claimed in claim 25, wherein the amount of the ultraviolet absorbent in the hydrophilic light-insensitive layer provided underneath the cyan coupler-containing silver halide emulsion layer is at most 100 mg per square meter.

30. The color photographic image forming method as claimed in claim 25, wherein the amount of the ultraviolet absorbent in the hydrophilic light-insensitive layer provided underneath the cyan coupler-containing silver halide emulsion layer is 0.

31. A method of producing silver halide color photographic images comprising the step of, color developing a silver halide color photographic material which has a total gelatin coverage of at most 7.5 g/$m^2$ and which comprises a reflecting support and provided thereon three light sensitive silver halide emulsion layers each having a light sensitivity to a different wavelength region, including a light sensitive silver halide emulsion layer which has a gelatin coverage of below 1.3 g/$m^2$ and containing a yellow dye forming coupler, a light sensitive silver halide layer containing a magenta dye forming coupler, and a light sensitive layer containing a cyan dye forming coupler, wherein said photographic material contains at least one magenta coupler represented by the following general formula (A) and/or a polymer coupler having a repeating unit obtained from a vinyl monomer containing a part represented by general formula (A) in its molecule in the magenta coupler-containing silver halide emulsion layer, and the cyan coupler-containing silver halide emulsion layer is situated in a position more distant from the support than the magenta coupler-containing silver halide emulsion layer, and wherein (a) a hydrophilic light-insensitive layer containing a compound represented by the following general formula (I) in the substantial absence of any ultraviolet absorbent is provided at the position underneath the cyan coupler-containing silver halide emulsion layer, (b) a hydrophilic light-insensitive layer containing an ultraviolet absorbent in the substantial absence of any compound represented by the following general formula (I) is provided above the cyan coupler-containing silver halide emulsion layer, and (c) silver halide grains contained in every emulsion layer have an average chloride content of at least 90 mol %; and wherein said color development is performed continuously with a color developing solution at a replenishment rate of at most 80 ml of replenisher per $m^2$ of silver halide color photographic material processed thereby;

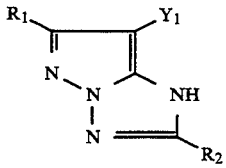

(A)

(wherein $R_1$ and $R_2$, which may be the same or different, each represents a hydrogen atom, a halogen atom, an aliphatic residue, an aryl group, a heterocyclic group, a cyano group, an alkoxy group, an aryloxy group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, a heterocyclicoxy group, an acyloxy group, a carbamoyloxy group, a silyloxy group, an aryloxycarbonylamino group, an imido group, a heterocyclicthio group, a sulfinyl group, a phosphonyl group, an aryloxycarbonyl group, an acyl group or an alkoxycarbonyl group; $Y_1$ represents a hydrogen atom or a group capable of being released upon coupling, or $R_1$, $R_2$ or $Y_1$ are independently a divalent group for forming a bis coupler, or $R_1$ or $R_2$ are independently a simple bond or a linking group through which the part represented by general formula (A) is bonded to a vinyl group of the vinyl monomer;

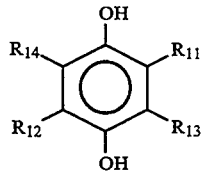

(I)

(wherein $R_{11}$ and $R_{12}$ may be the same or different and each represents a hydrogen atom, an alkyl group, an alkenyl group, an aryl group, an acyl group, a cycloalkyl group, a sulfonic acid group, a halogen atom or a heterocyclic group; $R_{13}$ and $R_{14}$ may be the same or different and each represents a hydrogen atom, a halogen atom, an alkyl group, an aryl group, a cycloalkyl group, an alkoxy group, an aryloxy group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group; provided that at least one among $R_{11}$, $R_{12}$, $R_{13}$ and $R_{14}$ is not a hydrogen atom).

32. The color photographic image forming method as claimed in claim 31, wherein the replenishment rate is from 30 to 70 ml per $m^2$ of the light-sensitive material processed.

33. The color photographic image forming method as claimed in claim 31, wherein the amount of the compound according to formula (I) in the hydrophilic light-insensitive layer provided above the cyan coupler-containing silver halide emulsion layer is less than 10 mg per square meter.

34. The color photographic image forming method as claimed in claim 31, wherein the amount of the compound according to formula (I) in the hydrophilic light-insensitive layer provided above the cyan coupler-containing silver halide emulsion layer is 0.

35. The color photographic image forming method as claimed in claim 31, wherein the amount of the ultraviolet absorbent in the hydrophilic light-insensitive layer provided underneath the cyan coupler-containing silver halide emulsion layer is at most 100 mg per square meter.

36. The color photographic image forming method as claimed in claim 31, wherein the amount of the ultraviolet absorbent in the hydrophilic light-insensitive layer provided underneath the cyan coupler-containing silver halide emulsion layer is 0.

37. A method of producing silver halide color photographic images comprising the step of, color developing a silver halide color photographic material which has a total gelatin coverage of at most 7.5 $g/m^2$ and which comprises a reflecting support and provided thereon three light sensitive silver halide emulsion layers each having a light sensitivity to a different wavelength region, including a light sensitive silver halide emulsion layer which has a gelatin coverage of below 1.3 $g/m^2$ and containing a yellow dye forming coupler, a light sensitive silver halide layer containing a magenta dye forming coupler, and a light sensitive layer containing a cyan dye forming coupler, wherein said photographic material contains at least one magenta coupler represented by the following general formula (A) in the magenta coupler-containing silver halide emulsion layer, and the cyan coupler-containing silver halide emulsion layer is situated in a position more distant from the support than the magenta coupler-containing silver halide emulsion layer, and wherein (a) a hydrophilic light-insensitive layer containing a compound represented by the following general formula (I) in the substantial absence of any ultraviolet absorbent is provided at a position underneath the cyan coupler-containing silver halide emulsion layer, (b) a hydrophilic light-insensitive layer containing an ultraviolet absorbent in the substantial absence of any compound represented by the following general formula (I) is provided above the cyan coupler-containing silver halide emulsion layer, and (c) silver halide grains contained in every emulsion layer have an average chloride content of at least 90 mol %; and wherein said color development is performed continuously with a color developing solution at a replenishment rate of at most 80 ml of replenisher per $m^2$ of silver halide color photographic material processed thereby;

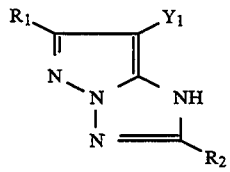

(A)

(wherein $R_1$ represents a hydrogen atom, a halogen atom, an aliphatic residue, an aryl group, a heterocyclic group, a cyano group, an alkoxy group, an aryloxy group, an acylamino group, an aniline group, a ureido group, a sulfamoylamino group, an alkylthio group, an arylthio group, an alkoxycarbonylamino group, a sulfonamido group, a carbamoyl group, a sulfamoyl group, a sulfonyl group, a heterocyclicoxy group, an acyloxy group, a carbamoyloxy group, a silyloxy group, an aryloxycarbonylamino group, an imido group, a heterocyclicthio group, a sulfinyl group, a phosphonyl group, an aryloxycarbonyl group, an acyl group or an alkoxycarbonyl group; $Y_1$ represents a hydrogen atom or a splitting off group; or $R_1$ or $Y_1$ are independently a divalent group for forming a bis coupler, or $R_1$ is a simple bond or a linking group through which a part represented by general formula (A) is bonded to a vinyl group of a vinyl monomer which is a repeating unit to form a polymer coupler; and $R_2$ represents

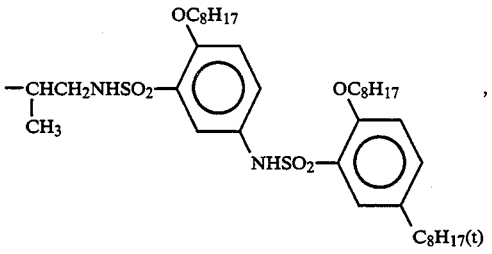

-continued

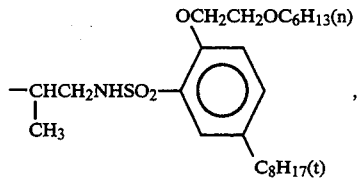

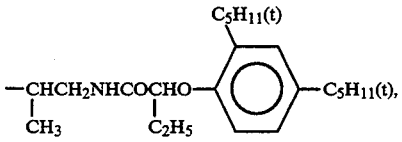

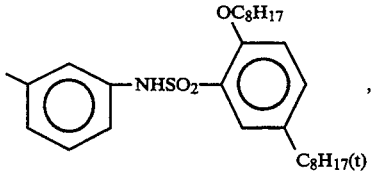

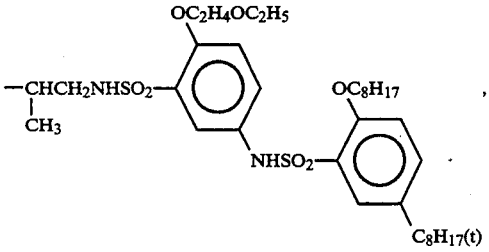

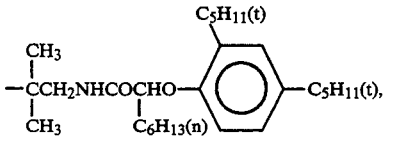

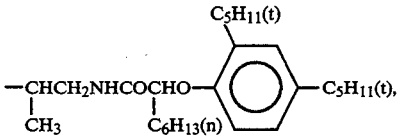

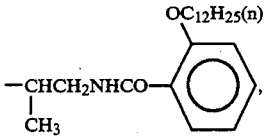

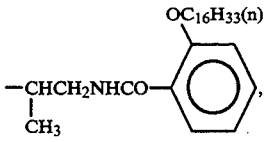

-continued

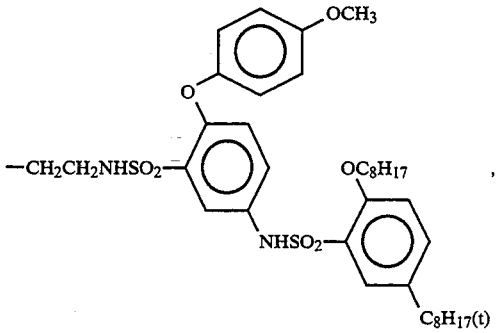

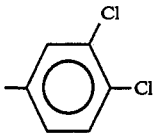

or

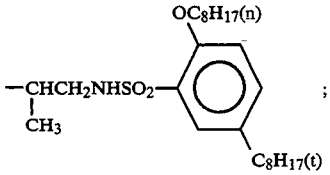

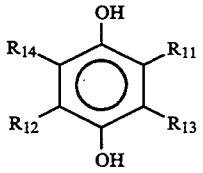

(I)

(wherein $R_{11}$ and $R_{12}$ may be the same or different and each represents a hydrogen atom, an alkyl group, an alkenyl group, an aryl group, an acyl group, a cycloalkyl group, a sulfonic acid group, a halogen atom or a heterocyclic group; $R_{13}$ and $R_{14}$ may be the same or different and each represents a hydrogen atom, a halogen atom, an alkyl group, an aryl group, a cycloalkyl group, an alkoxy group, an aryloxy group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group; provided that at least one among $R_{11}$, $R_{12}$, $R_{13}$ and $R_{14}$ is not a hydrogen atom).

38. A method of producing silver halide color photographic images comprising the step of, color developing a silver halide color photographic material which has a total gelatin coverage of at most 7.5 g/m$^2$ and which comprises a reflecting support and provided thereon three light sensitive silver halide emulsion layers each having a light sensitivity to a different wavelength region, including a light sensitive silver halide emulsion layer which has a gelatin coverage of below 1.3 g/m$^2$ and containing a yellow dye forming coupler, a light sensitive silver halide layer containing a magenta dye forming coupler, and a light sensitive layer containing a cyan dye forming coupler, wherein said photographic material contains at least one magenta coupler represented by the following general formula (B) in the magenta coupler-containing silver halide emulsion layer, and the cyan coupler-containing silver halide emulsion layer is situated in a position more distant from the support than the magenta coupler-containing silver halide emulsion layer, and wherein (a) a hydrophilic light-insensitive layer containing a compound represented by the following general formula (I) in the substantial absence of any ultraviolet absorbent is provided at a position underneath the cyan coupler-containing silver halide emulsion layer, (b) a hydrophilic light-insensitive layer containing an ultraviolet absorbent in the substantial absence of any compound represented by the following general formula (I) is provided above the cyan coupler-containing silver halide emulsion layer, and (c) silver halide grains contained in every emulsion layer have an average chloride content of at least 90 mol %; and wherein said color development is performed continuously with a color developing solution at a replenishment rate of at most 80 ml of replenisher per $m^2$ of silver halide color photographic material processed thereby;

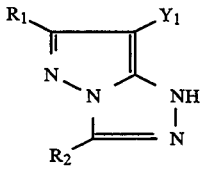

(B)

(wherein $R_1$ represents a hydrogen atom, a halogen atom, an aliphatic residue, an aryl group, a heterocyclic group, a cyano group, an alkoxy group, an aryloxy group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, a heterocyclicoxy group, an acyloxy group, a carbamoyloxy group, a silyloxy group, an aryloxycarbonylamino group, an imido group, a heterocyclicthio group, a sulfinyl group, a phosphonyl group, an aryloxycarbonyl group, an acyl group or an alkoxycarbonyl group; $Y_1$ represents a hydrogen atom or a splitting off group; or $R_1$ or $Y_1$ are independently a divalent group for forming a bis coupler, or $R_1$ is a simple bond or a linking group through which a part represented by general formula (B) is bonded to a vinyl group of a vinyl monomer which is a repeating unit to form a polymer coupler; and $R_2$ represents

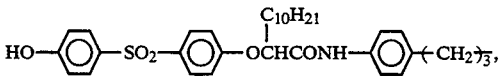

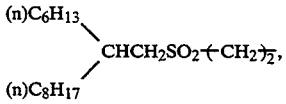

-continued

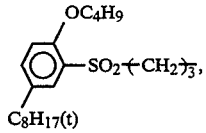

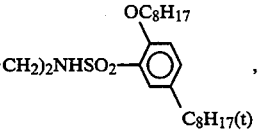

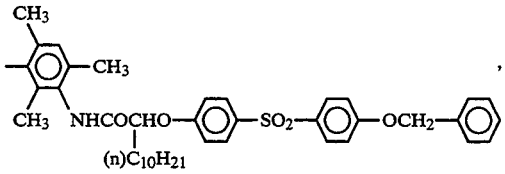

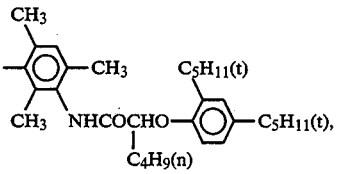

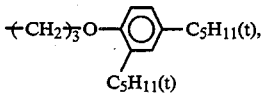

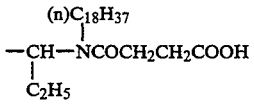

or $-(CH_2)_3SO_2C_{12}H_{25}(n)$;

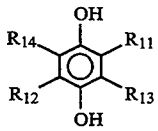

(I)

(wherein $R_{11}$ and $R_{12}$ may be the same or different and each represents a hydrogen atom, an alkyl group, an alkenyl group, an aryl group, an acyl group, a cycloalkyl group, a sulfonic acid group, a halogen atom or a heterocyclic group; $R_{13}$ and $R_{14}$ may be the same or different and each represents a hydrogen atom, a halogen atom, an alkyl group, an aryl group, a cycloalkyl group, an alkoxy group, an aryloxy group, an arylthio group, an acyl group, an alkylacylamino group, an arylacylamino group, an alkylcarbamoyl group, an arylcarbamoyl group, an alkylsulfonamido group, an arylsulfonamido group, an alkylsulfamoyl group, an arylsulfamoyl group, an alkylsulfonyl group, an arylsulfonyl group, a nitro group, a cyano group, an alkyloxycarbonyl group, an aryloxycarbonyl group, an alkylacyloxy group or an arylacyloxy group; provided that at least one among $R_{11}$, $R_{12}$, $R_{13}$ and $R_{14}$ is not a hydrogen atom).

* * * * *